US007847769B2

(12) United States Patent
Lee

(10) Patent No.: US 7,847,769 B2
(45) **Date of Patent: *Dec. 7, 2010**

(54) LIQUID CRYSTAL DISPLAY AND DRIVING METHOD THEREOF

(75) Inventor: Seung-Woo Lee, Seoul (KR)

(73) Assignee: Samsung Electronics Co., Ltd. (KR)

( * ) Notice: Subject to any disclaimer, the term of this patent is extended or adjusted under 35 U.S.C. 154(b) by 520 days.

This patent is subject to a terminal disclaimer.

(21) Appl. No.: 11/619,367

(22) Filed: Jan. 3, 2007

(65) Prior Publication Data

US 2007/0109242 A1 May 17, 2007

Related U.S. Application Data

(63) Continuation of application No. 10/404,416, filed on Mar. 31, 2003, now Pat. No. 7,176,867.

(30) Foreign Application Priority Data

Apr. 1, 2002 (KR) ..... 2002-0017793
May 13, 2002 (KR) ..... 2002-0026218

(51) Int. Cl.
*G09G 3/36* (2006.01)

(52) U.S. Cl. ..... 345/87; 345/88; 345/98

(58) Field of Classification Search ..... 345/87–102, 345/204, 690–696
See application file for complete search history.

(56) References Cited

U.S. PATENT DOCUMENTS 5,552,800 A * 9/1996 Uchikoga et al. ..... 345/89
5,677,704 A * 10/1997 Kusano et al. ..... 345/89
5,712,651 A 1/1998 Tomiyasu
5,774,101 A 6/1998 Hirai et al.
6,091,386 A * 7/2000 Bassetti et al. ..... 345/87
6,278,496 B1 * 8/2001 Kitagawa et al. ..... 348/674
6,396,465 B1 * 5/2002 Nakagiri ..... 345/69
6,727,879 B2 * 4/2004 Sako ..... 345/98
6,788,306 B2 * 9/2004 Yamaguchi et al. ..... 345/596
6,862,012 B1 * 3/2005 Funakoshi et al. ..... 345/88
6,894,670 B2 * 5/2005 Funakoshi et al. ..... 345/89
7,030,846 B2 4/2006 Lee et al.
7,176,867 B2 * 2/2007 Lee ..... 345/89
2001/0033262 A1 10/2001 Funakoshi et al.
2002/0105491 A1 * 8/2002 Yamaguchi et al. ..... 345/89
2003/0001810 A1 * 1/2003 Yamaguchi et al. ..... 345/87
2003/0016199 A1 * 1/2003 Lee et al. ..... 345/88

(Continued)

FOREIGN PATENT DOCUMENTS

JP 06161391 6/1994

(Continued)

OTHER PUBLICATIONS

Taiwan Search Report; Mar. 3, 2007; Patent Application No. 092107389.

*Primary Examiner*—Nitin Patel
(74) *Attorney, Agent, or Firm*—Cantor Colburn LLP

(57) ABSTRACT

According to an embodiment of the present invention, a method of driving a liquid crystal display by frame rate control (FRC) is provided, which includes: receiving an input data having a first gray from an external graphic source; converting the input data to have bit number larger than the input data; and performing FRC on the converted data.

14 Claims, 15 Drawing Sheets

| Input | Mapped | Upper 6bits | Lower 2bits | Remark |
|---|---|---|---|---|
| 255 | 252 | 111111 | 00 | ▲ |
| 254 | 251 | 111110 | 11 | ▲ |
| 253 | 250 | 111110 | 10 | ▲ |
| 252 | 249 | 111110 | 01 | ▲ |
| 251 | 248 | 111110 | 00 | ▲ |
| 250 | 247 | 111101 | 11 | ▲ |
| * | * | * | * | |
| 6 | 3 | 000000 | 11 | ▲ |
| 5 | 2 | 000000 | 10 | ▲ |
| 4 | 1 | 000000 | 01 | ▲ |
| 3 | 0 | 000000 | 00 | Equal gray |
| 2 | 0 | 000000 | 00 | |
| 1 | 0 | 000000 | 00 | |
| 0 | 0 | 000000 | 00 | |

U.S. PATENT DOCUMENTS

| | | | | |
|---|---|---|---|---|
| 2003/0179170 | A1* | 9/2003 | Lee | 345/87 |
| 2003/0184569 | A1* | 10/2003 | Koga et al. | 345/690 |
| 2004/0257325 | A1* | 12/2004 | Inoue | 345/89 |
| 2008/0170019 | A1* | 7/2008 | Kato | 345/89 |

FOREIGN PATENT DOCUMENTS

| | | | |
|---|---|---|---|
| JP | 08227283 | | 9/1996 |
| JP | 10301533 | | 11/1998 |
| JP | 11-015444 | A | 1/1999 |
| JP | 11030970 | | 2/1999 |
| JP | 11231847 | | 8/1999 |
| JP | 11249628 | | 9/1999 |
| JP | 11272236 | | 10/1999 |
| JP | 11288241 | | 10/1999 |
| JP | 11311976 | | 11/1999 |
| JP | 2000020037 | | 1/2000 |
| JP | 2000056525 | | 2/2000 |
| JP | 2000082138 | | 3/2000 |
| JP | 2000099684 | | 4/2000 |
| JP | 2001075521 | | 3/2001 |
| JP | 2001109452 | | 4/2001 |
| JP | 2001142437 | | 5/2001 |
| JP | 2001-306036 | A | 11/2001 |
| JP | 2003-288058 | A | 10/2003 |
| KR | 1998066488 | B1 | 9/1999 |
| KR | 1020000020842 | | 4/2000 |
| TW | 289109 | | 10/1996 |
| TW | 516011 | | 1/2003 |

* cited by examiner

| Input | Mapped | Upper 6bits | Lower 2bits | Remark |
|---|---|---|---|---|
| 255 | 252 | 111111 | 00 | ▲ |
| 254 | 251 | 111110 | 11 | ▲ |
| 253 | 250 | 111110 | 10 | ▲ |
| 252 | 249 | 111110 | 01 | ▲ |
| 251 | 248 | 111110 | 00 | ▲ |
| 250 | 247 | 111101 | 11 | ▲ |
| * | * | * | * | |
| 6 | 3 | 000000 | 11 | ▲ |
| 5 | 2 | 000000 | 10 | ▲ |
| 4 | 1 | 000000 | 01 | ▲ |
| 3 | 0 | 000000 | 00 | Equal gray |
| 2 | 0 | 000000 | 00 | |
| 1 | 0 | 000000 | 00 | |
| 0 | 0 | 000000 | 00 | |

| Lower 3Bits | Frame No. 1 | 2 | 3 | 4 | 5 | 6 | 7 | 8 |
|---|---|---|---|---|---|---|---|---|
| 000 |  | | | | | | | |
| 010 |  | | | | | | | |
| 100 |  | | | | | | | |
| 110 |  | | | | | | | |
| 001 |  | | | | | | | |
| 011 |  | | | | | | | |
| 101 |  | | | | | | | |
| 111 |  | | | | | | | |

| Lower 3Bits | 1 | 2 | 3 | 4 | $\overline{5}$ | $\overline{6}$ | $\overline{7}$ | $\overline{8}$ |
|---|---|---|---|---|---|---|---|---|
| 000 |  |  |  |  |  |  |  |  |
| 010 |  |  |  |  |  |  |  |  |
| 100 |  |  |  |  |  |  |  |  |
| 110 |  |  |  |  |  |  |  |  |
| 001 |  |  |  |  |  |  |  |  |
| 011 |  |  |  |  |  |  |  |  |
| 101 |  |  |  |  |  |  |  |  |
| 111 |  |  |  |  |  |  |  |  |

| Lower 3Bits | 1 | $\overline{5}$ | 2 | $\overline{6}$ | 3 | $\overline{7}$ | 4 | $\overline{8}$ |
|---|---|---|---|---|---|---|---|---|
| 000 |  |  |  |  |  |  |  |  |
| 010 |  |  |  |  |  |  |  |  |
| 100 |  |  |  |  |  |  |  |  |
| 110 |  |  |  |  |  |  |  |  |
| 001 |  |  |  |  |  |  |  |  |
| 011 |  |  |  |  |  |  |  |  |
| 101 |  |  |  |  |  |  |  |  |
| 111 |  |  |  |  |  |  |  |  |

| Lower 3Bits | $\overline{5}$ | 1 | $\overline{6}$ | 2 | $\overline{7}$ | 3 | $\overline{8}$ | 4 |
|---|---|---|---|---|---|---|---|---|
| 000 |  |  |  |  |  |  |  |  |
| 010 |  |  |  |  |  |  |  |  |
| 100 |  |  |  |  |  |  |  |  |
| 110 |  |  |  |  |  |  |  |  |
| 001 |  |  |  |  |  |  |  |  |
| 011 |  |  |  |  |  |  |  |  |
| 101 |  |  |  |  |  |  |  |  |
| 111 |  |  |  |  |  |  |  |  |

LIQUID CRYSTAL DISPLAY AND DRIVING METHOD THEREOF

CROSS REFERENCE TO RELATED APPLICATIONS

This application is a continuation application of U.S. application Ser. No. 10/404,416 filed Mar. 31, 2003, which claims priority to and the benefit of Korean Patent Application No. 2002-0017793 filed on Apr. 1, 2002 and Korean Patent Application No. 2002-0026218 filed on May 13, 2002, all of which are incorporated by reference herein in their entirety.

BACKGROUND OF THE INVENTION (a) Field of the Invention

The present invention relates to a liquid crystal display and a driving method thereof and, more particularly, to a liquid crystal display performing frame rate control and a driving method thereof.

(b) Description of the Related Art

Flat panel displays such as liquid crystal displays (LCDs) have been developed and substituted for cathode ray tubes (CRTs) since they are suitable for recent personal computers and televisions, which become lighter and thinner.

An LCD representing the flat panel displays includes a liquid crystal panel assembly including two panels provided with two kinds of field generating electrodes such as pixel electrodes and a common electrode and a liquid crystal layer with dielectric anisotropy interposed therebetween. The variation of the voltage difference between the field generating electrodes, i.e., the variation in the strength of an electric field generated by the electrodes changes the transmittance of the light passing through the LCD, and thus desired images are obtained by controlling the voltage difference between the electrodes. A typical LCD includes thin film transistors (TFTs) as switching elements for controlling the voltages to be applied to the pixel electrodes, and a plurality of display signal lines for transmitting signals to be applied to the TFTs.

The LCD receives N-bit red (R), green (G) and blue (B) data from an external graphic source. A signal controller of the LCD converts the format of the RGB data, and a driving integrated circuit (IC) of the LCD selects analog gray voltages corresponding to the RGB data. The selected gray voltages are applied to a liquid crystal panel assembly, thereby displaying images.

The bit number of the RGB data input into the signal controller from the graphic source is usually equal to the bit number of data capable of being processed at the driving IC. Currently available LCD products usually process 8-bit data using driving ICs capable of processing 8-bit RGB data, which costs high. Therefore, in order to design a cost-effective LCD, it is required to select a driving IC having a capability of processing the data with the bit number smaller than eight.

In this connection, it has been proposed that frame rate control (FRC) should be applied for use in the LCD. The FRC reconstructs frame data such that an LCD having several driving ICs processing (N-M)-bit data displays images using only (N-M) bits among the N bits of an N-bit input RGB data, where M indicate the bit number of the lower bits of the input RGB data. The FRC converts the N-bit input data into an (N-M)-bit data such that among consecutive $2^M$ frames, the number of frames where the converted data has a gray 'A' indicated by the upper (N-M) bits of the input data and the number of frames where the converted data has the next higher gray 'A+1' are regulated based on the lower M bits of the RGB data. Furthermore, the FRC converts the N-bit input data into a predetermined number of (N-M)-bit data respectively assigned to pixels in a group of the predetermined number of pixels such that the total number of pixels displaying the gray 'A' and the total number of pixels displaying the gray 'A+1' during a predetermined number of frames are regulated depending on the lower M bits of the RGB data. Since human eyes recognize spatio-temporal average of the gray of the (N-M)-bit data, the image appears the same as that represented by the N-bit data. Consequently, $2^M$ additional grays between the grays of 'A' and 'A+1' can be displayed.

For example, let us consider an 8-bit input data with six upper bits and two lower bits. The 8-bit data can represent $2^8$ (=256) grays ranging from '0' to '255'. The upper 6 bits of the input data representing the highest four grays '255', '254', '253' and '252' are equal to '111111.' Since there is no 6-bit number larger than '111111' by one, the FRC cannot be applied to these data and thus the input data representing any one of the highest four grays should be represented by a single 6-bit data '111111' for all the frames. This causes gamma degeneracy for the highest four grays. Then, each of red, green and blue colors has only 253 grays, the total number of colors obtained by mixing these primary RGB colors is 253×253×253 (=16,194,277), which is smaller than the number of colors obtained by mixing the primary colors having entire 256 grays, i.e., 256×256×256 (=16,777,216), by about six hundred thousand.

Meanwhile, a conventional LCD with FRC has deteriorated image quality. For instance, when a lower part of a display screen displays a black image while an upper part of the screen displays an image with increasing or decreasing grays along a vertical line to have maximum brightness for each of red, green, blue and white colors, a plurality of horizontal lines are displayed every four grays, and this seriously deteriorates the picture image quality. Such a phenomenon seems to be generated due to frame inversion together with the FRC.

SUMMARY OF THE INVENTION

According to an embodiment of the present invention, a method of driving a liquid crystal display by frame rate control (FRC) is provided, which includes: receiving a raw data having a gray from an external graphic source; converting the raw data having a gray such that the gray of the converted data for the raw data having the gray equal to any one of a predetermined number of lowermost grays is equal to a predetermined gray, and the second gray of the converted data for the raw data having the gray other than the predetermined number of lowermost grays is equal to the gray of the raw data subtracted by the predetermined number; and performing FRC on the converted data.

The predetermined number is equal to $(2^{\alpha}-1)$, where $\alpha$ is bit number of lower bits of the raw data required for the FRC. The predetermined gray is preferably equal to zero. It is preferable that the bit number of the raw data is eight and the bit number of the lower bits of the converted data required for the FRC is two.

According to another embodiment of the present invention, a method of driving a liquid crystal display by frame rate control (FRC) is provided, which includes: receiving an input data having a first gray from an external graphic source; converting the input data to have bit number larger than the input data; and performing FRC on the converted data.

A liquid crystal display according to another embodiment of the present invention is provided, which includes: a liquid crystal panel assembly including a plurality of pixels arranged in a matrix; a signal controller converting input data into image data having bit number larger than the input data and performing frame rate control (FRC) on the converted data; and a data driver for applying data voltages to the respective pixels of the liquid crystal panel assembly in accordance with the converted data.

The FRC is performed preferably in time and space, and a spatial unit for the FRC is a pixel block, which includes a 4×2 pixel matrix.

It is preferable that the FRC is performed such that adjacent two pixel blocks are subject to different one of a normal frame and a conjugate frame, and the FRC is performed such that the pixel block is subject to different one of a normal frame and a conjugate frame for two adjacent frames.

Preferably, each of the pixels represents one of three primary colors, and the FRC is performed in conjugate manner for two of the primary colors and the remaining one of the primary colors.

The converted data has a second gray, and the conversion preferably includes mapping of the first gray into the second gray, and in particular, includes a one-to-one mapping.

According to an embodiment of the present invention, the FRC is performed such that first $2^{\alpha-1}$ frames and second $2^{\alpha-1}$ frames for first-type lower bits of the converted data required for the FRC, which have a lowest bit of zero, are substantially the same, and first $2^{\alpha-1}$ frames for second-type lower bits of the converted data, which have a lowest bit of one, are the same as the first $2^{\alpha-1}$ frames for the lower bits, which have a value less than the second-type lower bits by one, and second $2^{\alpha-1}$ frames for second-type lower bits are the same as the second $2^{\alpha-1}$ frames for the lower bits, which have a value larger than the second-type lower bits by one, where a is bit number of the lower bits of the converted data required for the FRC.

According to another embodiment of the present invention, the FRC is performed such that first $2^{\alpha-1}$ frames and second $2^{\alpha-1}$ frames for first-type lower bits of the converted data required for the FRC, which have a lowest bit of zero, are conjugate to each other, and first $2^{\alpha-1}$ frames for second-type lower bits of the converted data, which have a lowest bit of one, are the same as the first $2^{\alpha-1}$ frames for the lower bits, which have a value less than the second-type lower bits by one, and second $2^{\alpha-1}$ frames for second-type lower bits are conjugate to the second $2^{\alpha-1}$ frames for the lower bits, which have a value larger than the second-type lower bits by one, where $\alpha$ is bit number of the lower bits of the converted data required for the FRC.

According to another embodiment of the present invention, the FRC is performed such that $2^{\alpha-1}$ pairs of odd and even frames conjugate to each other for first-type lower bits of the converted data required for the FRC, which have a lowest bit of zero, are alternately arranged, and odd frames for second-type lower bits of the converted data, which have a lowest bit of one, are the same as the odd frames for the lower bits, which have a value less than the second-type lower bits by one, and even frames for second-type lower bits are the same as the even frames for the lower bits, which have a value larger than the second-type lower bits by one, where a is bit number of the lower bits of the converted data required for the FRC.

Preferably, the bit number of the input data is eight, the bit number of the converted data is nine, and the bit number of the lower bits of the converted data required for the FRC is three.

According to an embodiment of the present invention, the mapping is given by a relation:

$$G' = \left(\frac{63}{255}G \times 8\right)_{rounding},$$

where G is the first gray, G' is the second gray, and $(\ )_{Rounding}$ means that the number in the parenthesis is rounded off to an integer.

According to another embodiment of the present invention, the mapping is given by a relation:

$$G' = 504 \text{ if } G = 255; \text{ and}$$

$$G' = \left(\frac{63}{256}G \times 8\right)_{rounding} = \left(\frac{63}{32}G\right)_{rounding} \text{ if } G \text{ is not } 255,$$

where G is the first gray, G' is the second gray, and $(\ )_{Rounding}$ means that the number in the parenthesis is rounded off to an integer.

According to another embodiment of the present invention, the mapping is given by a relation:

$$G' = G \text{ if } G \le 6; \text{ and}$$

$$G' = \left(\left[\frac{64}{256}(G+1) - 1\right] \times 8\right) = 2G - 6 \text{ if } 6 < G \le 255,$$

where G is the first gray, G' is the second gray.

According to another embodiment of the present invention, the mapping is given by a relation:

$$G' = 504 \text{ if } G = 255; \text{ and}$$

$$G' = \left(\left[\frac{63}{256}(G+1) - \frac{1}{8}\right] \times 8\right)_{rounding} = \left[\frac{63}{32}(G+1) - 1\right]_{rounding} \text{ if } G \text{ is not } 255,$$

where G is the first gray, G' is the second gray, and $(\ )_{Rounding}$ means that the number in the parenthesis is rounded off to an integer.

According to another embodiment of the present invention, when the mapping is given by a relation:

$$G' = G \text{ if } G \le 8;$$

$$G' = 504 \text{ if } G = 255; \text{ and}$$

$$G' = 2G - 8 \text{ if } 8 < G < 255,$$

where G is the first gray, G' is the second gray.

BRIEF DESCRIPTION OF THE DRAWINGS

The above and other advantages of the present invention will become more apparent by describing preferred embodiments thereof in detail with reference to the accompanying drawings in which.

DETAILED DESCRIPTION OF PREFERRED EMBODIMENTS

Figures 1, 2:
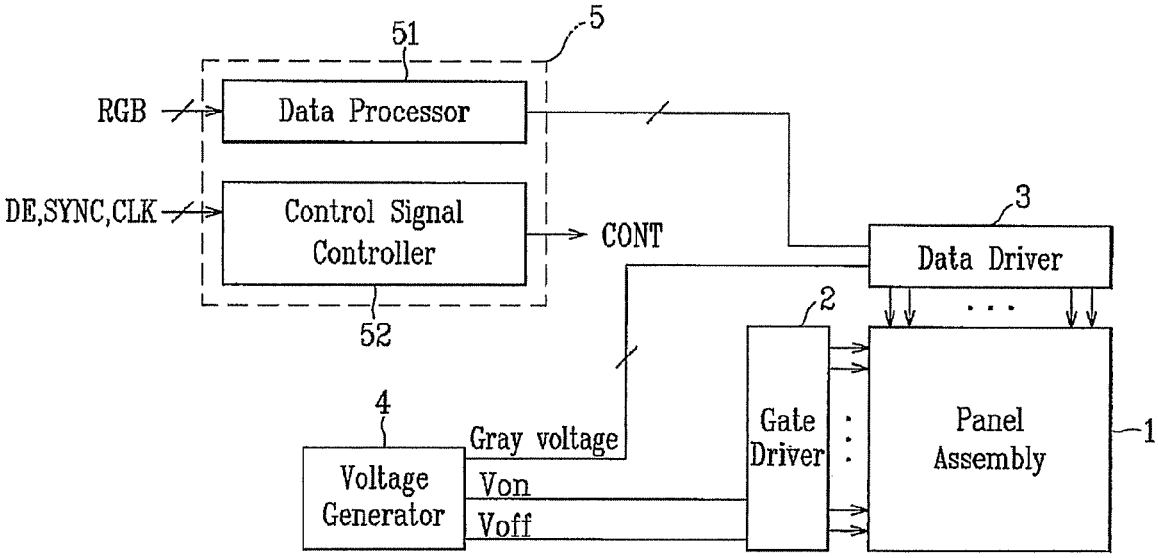
FIG. 1 is a schematic block diagram of an LCD according to an embodiment of the present invention.
FIG. 2 is a table for illustrating an exemplary FRC on 8-bit RGB input data with upper 6 bits and lower 2 bits according to an embodiment of the present invention.

The present invention now will be described more fully hereinafter with reference to the accompanying drawings, in which preferred embodiments of the inventions invention are shown. The present invention may, however, be embodied in many different forms and should not be construed as limited to the embodiments set forth herein.

In the drawings, the thickness of layers and regions are exaggerated for clarity. Like numerals refer to like elements throughout. It will be understood that when an element such as a layer, region or substrate is referred to as being "on" another element, it can be directly on the other element or intervening elements may also be present. In contrast, when an element is referred to as being "directly on" another element, there are no intervening elements present.

Now, LCDs and driving methods thereof according to embodiments of this invention will be described in detail with reference to the accompanying drawings.

FIG. 1 schematically illustrates an LCD according to an embodiment of the present invention.

As shown in FIG. 1, an LCD includes a liquid crystal panel assembly 1, a gate driver 2, a data driver 3, a voltage generator 4, and a signal controller 5 including a data processor 51 and a control signal generator 52.

The liquid crystal panel assembly 1 includes a plurality of gate lines, a plurality of data lines intersecting the gate lines, and a plurality of pixels connected to the gate lines and the data lines. Whenever the gate lines are sequentially scanned, analog voltages for displaying an image are applied to the relevant pixels via the data lines.

The voltage generator 4 generates a gate-on voltage Von and a gate-off voltage Voff for scanning the gate lines to be provided for the gate driver 2. At the same time, the voltage generator 4 generates a plurality of gray voltages to be supplied for the data driver 3.

The signal controller 5 receives RGB data, a data enable signal DE indicating valid data, a synchronization signal SYNC, and a clock signal CLK from an external graphic source. The data processor 51 processes the RGB data to be transmitted to the data driver 3. The RGB data are converted into data voltages selected from the gray voltages by the data driver 3 and supplied to the liquid crystal panel assembly 1. The control signal generator 52 generates various control signals for controlling the display operations based on the data enable signal DE, the synchronization signal SYNC and the clock signal CLK to be transmitted to the respective components.

The processing of the data processor 51 includes FRC on the RGB input data, which is now described in detail with reference to the figures.

According to an embodiment of the present invention, the data processor 51 first maps $2^N$ grays (or values) of N-bit input data into a smaller number of grays. A predetermined number of the lowermost grays are mapped into one gray such as the lowest gray. Throughout the specification, it is assumed that the light transmittance increases as the gray increases. The predetermined number is determined by the bit number $\alpha$ of the lower bits of the N-bit input data. For example, the lowermost ($2^{\alpha-1}$) grays from the lowest gray are mapped into the lowest gray. The remaining grays are one-to-one mapped into lower grays. For example, the i-th gray ($i \geqq 2^{\alpha}$) is mapped into the $(i-(2^{\alpha}-1))$-th gray.

Referring to FIG. 2, which is a table for illustrating an exemplary FRC on 8-bit RGB input data with upper 6 bits and lower 2 bits according to this embodiment of the present invention, all the lowermost three ($=2^2-1$) grays from the lowest gray, i.e., the 0th, the 1st and the 2nd grays are mapped into the 0th gray, and any one of the remaining grays is mapped into a gray smaller than its original gray by three.

Then, an N-bit data having a mapped gray is subject to FRC. That is, the N-bit data is converted into an (N-$\alpha$)-bit data such that the value of the (N-$\alpha$)-bit data is selected from the value 'A' of the upper (N-$\alpha$) bits of the N-bit data and the next higher value 'A+1', and the frequency of the values 'A' and 'A+1' of the (N-$\alpha$)-bit data in consecutive $2^{\alpha}$ frames depends on the value of the lower a bits of the N-bit data.

Referring to FIG. 2, an 8-bit input data having the 6th gray or a value (00000110) becomes to have the 3rd gray or a value (00000011) by the gray mapping, and then converted by FRC into a 6-bit data having a value (000000) for one frame among consecutive four frames and a value (000001) for the remaining three frames. For another example, an 8-bit input data having the 253rd gray or a value (11111101) becomes to have the 250th gray or a value (11111010) by the gray mapping, and then converted by FRC into a 6-bit data having a value (111110) for two frames among consecutive four frames and a value (111111) for the remaining two frames. In the meantime, an 8-bit input data having one of the 0th to the 3rd grays or one of the lowermost four values (00000000), (00000001), (00000010) and (00000011) from the lowest value becomes to have the 0th gray or the lowest value (00000000) by the gray mapping, and then converted by FRC into a 6-bit data having a constant value (000000) for consecutive four frames.

Figure 3:
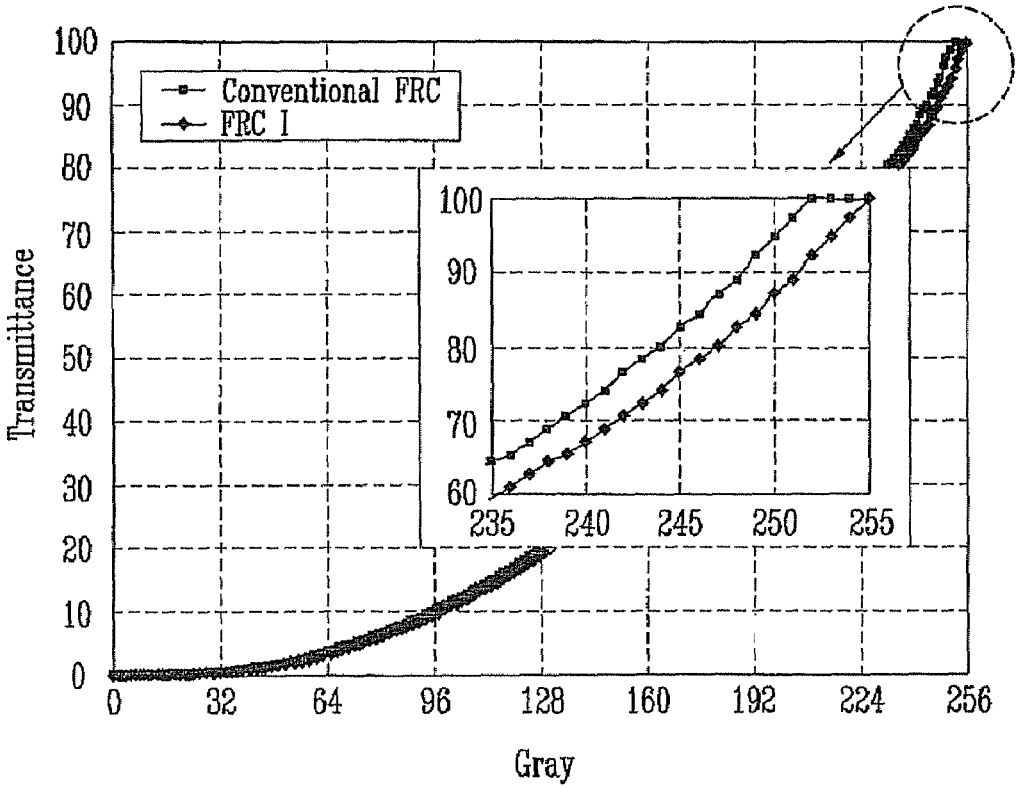
FIG. 3 is a graph illustrating the light transmittance as function of gray of 8-bit input data of an LCD according to an embodiment of the present invention.

FIG. 3 is a graph illustrating the light transmittance as function of gray of 8-bit input data of an LCD according to this embodiment of the present invention.

As shown in FIG. 3, the degeneracy of the higher grays of a normally black mode LCD, which can be easily recognized by human eyes, is removed. Although there is a degeneracy of the lower grays, it is hard for human eyes to recognize and thus it is relatively allowable.

This technique is particularly advantageous to an sRGB application monitor.

Figure 4:
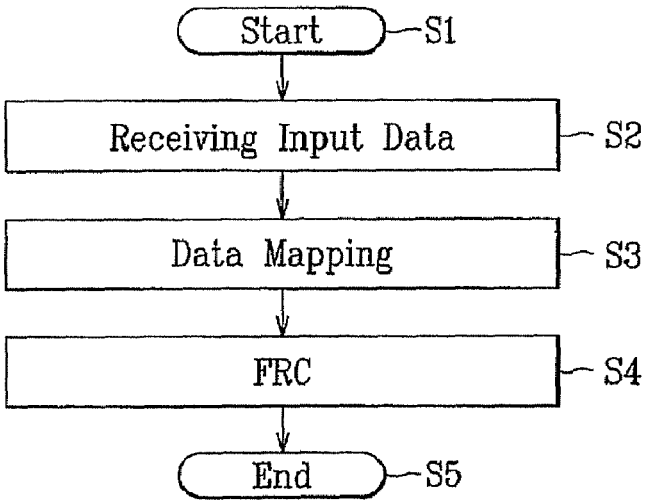
FIG. 4 is a flow chart illustrating an exemplary FRC according to another embodiment of the present invention.

FIG. 4 is a flow chart illustrating an exemplary FRC according to another embodiment of the present invention.

Referring to FIG. 4, upon the beginning of a procedure (S1), a signal controller of an LCD receives an N-bit RGB input data (S2) and maps the N-bit input data into an E-bit data (S3). After the E-bit data is subject to FRC with lower β bits of the E-bit data (S4), the procedure is ended (S5).

For instance, an 8-bit RGB input data is one-to-one mapped into a 9-bit data, which in turn is subject to FRC with its lower 3 bits. That is, the 9-bit data is converted into eight ($8=2^3$) 6-bit data respectively assigned to eight pixels adjacent to each other such that the value of each of the 6-bit data is selected from the value 'A' of the upper 6 bits of the 9-bit data and the next higher value 'A+1', while the frequency of the values 'A' and 'A+1' of each of the 6-bit data in eight ($8=2^3$) consecutive frames depends on the value of the lower 3 bits of the 9-bit data and the ratio of the total number of the pixels having the value 'A' and the total number of the pixels having the value 'A+1' in the eight consecutive frames depends on the value of the lower 3 bits of the 9-bit data.

For example, when the value of the lower bits of the 9-bit data is (101), each 6-bit data has the value 'A+1' for five frames among consecutive eight frames while it has the value 'A' for the remaining three frames.

In spatial view, for each of the eight frames, five of the eight pixels have the value 'A+1' while the remaining three pixels have the value 'A'. Alternatively, four of the eight pixels have the value 'A+1' for each of the first four frames, while six of the eight pixels have the value 'A+1' for each of the next four frames. The arrangements of the pixels representing the values 'A' and 'A+1' in the respective frames are determined in consideration of symmetry and uniformity of distribution.

Figure 5:
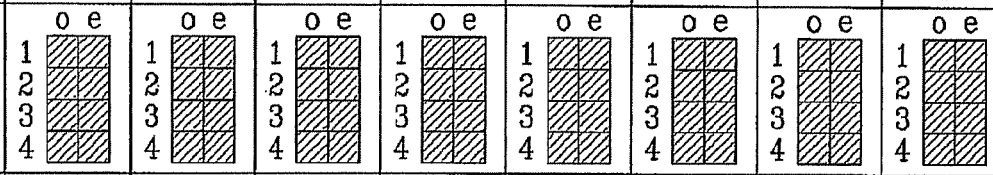
FIG. 5 is a table for illustrating an exemplary FRC on 8-bit RGB input data according to another embodiment of the present invention.
Figure 5:
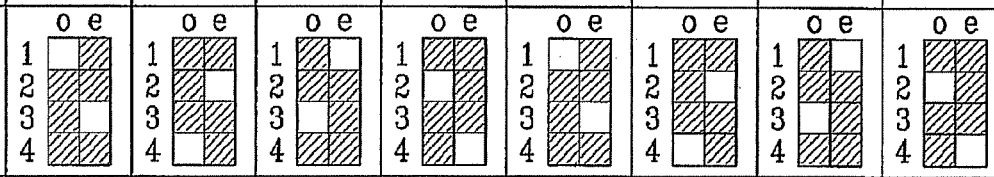
Figure 5:
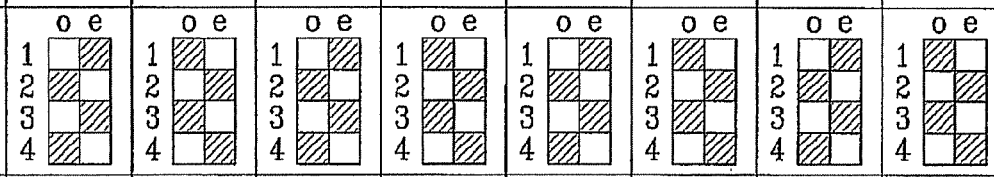
Figure 5:
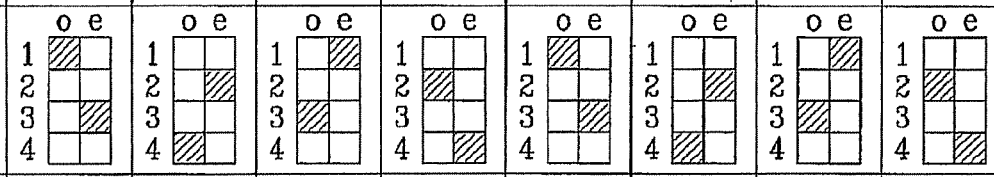
Figure 5:
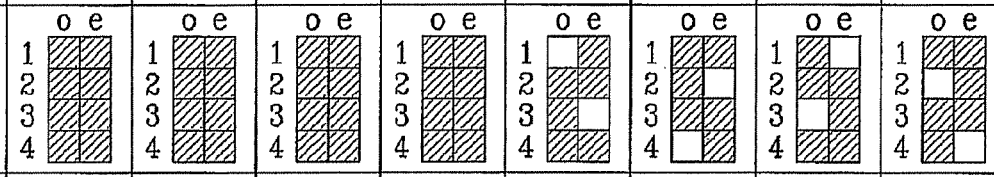
Figure 5:
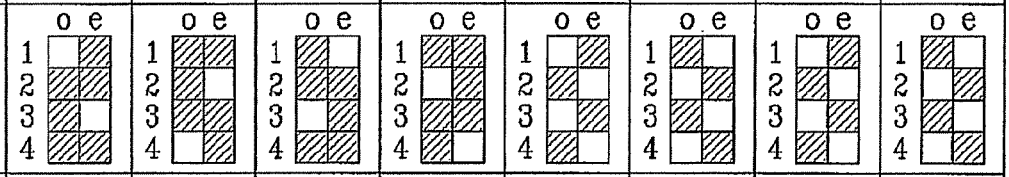
Figure 5:
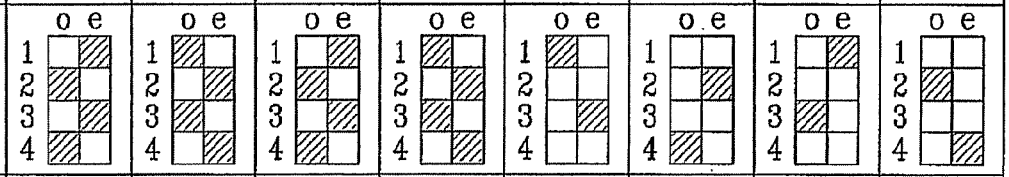
Figure 5:
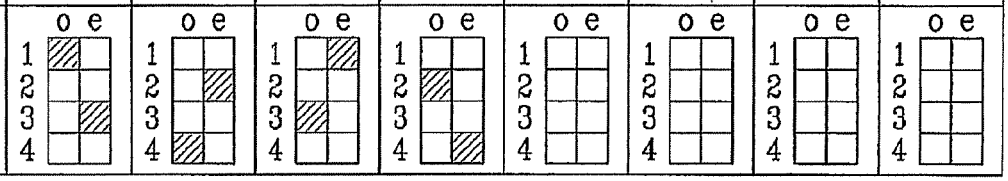

FIG. 5 is a table for illustrating an exemplary FRC on 8-bit RGB input data with N=8, E=9 and β=3 according to this embodiment of the present invention.

FIG. 5 shows eight pixels forming a 4×2 pixel block including an upper 2×2 matrix and a lower 2×2 matrix. Hatched pixels in the pixel block has a gray value ('A') represented by the upper 6 bits of the 9-bit data, and white pixels has a value ('A+1') equal to the gray value represented by the upper 6 bits plus one, that is, the next higher gray value. The letter 'O' in the figure is the abbreviation of the word 'odd' and indicates the odd column, while the letter 'E' is the abbreviation of the word 'even' and indicates the even column.

Referring to FIG. 5, the lower 3 bits of the 9-bit data indicate the number of frames among the eight frames for which every pixel has the gray 'A+1'.

In each frame, the number of the pixels having the value 'A+1' is an even number including zero, and the number of the pixels having the value 'A+1' in the upper 2×2 matrix is the same as that in the lower 2×2 matrix. The number of the pixels having the value 'A+1' in the first and the second rows of the upper 2×2 matrix is the same as that in the first and the second rows of the lower 2×2 matrix, respectively, and the number of the pixels having the value 'A+1' in the odd column is the same as that in the even column.

In a pair of consecutive odd and even frames, the arrangements of the pixels of each of the 2×2 matrices in the odd frame and in the even frame are reversed. For example, if the pixel at the first row and the odd column of a 2×2 matrix is the only one having the value 'A+1' (or 'A') in the first frame, the pixel at the second row and the even column is the only one, which has the value 'A+1' (or 'A') in the second frame, as shown in FIG. 5. For another example, if only the pixels at the first row and the odd column and at the second row and the even column of a 2×2 matrix have the value 'A+1' (or 'A') in the first frame, only the pixels at the first row and the even column and at the second row and the odd column of a 2×2 matrix have the value 'A+1' (or 'A') in the second frame.

In addition, the number of the pixels having the value 'A+1' is fixed for all of the first four frames or for all of the second four frames. When the number of the pixels having the gray 'A+1' in each of the upper and the lower 2×2 matrix is odd, the arrangements of the pixels in the first four frames (and the second four frames) are different from each other. On the contrary, when the number of the pixels having the gray 'A+1' in each of the upper and the lower 2×2 matrix is even, the arrangements of the pixels in the first and the second frames of the first four frames (and the second four frames) are the same as those in the third and the fourth frames of the first four frames (and the second four frames), respectively, and the number of the pixels having the value 'A+1' in the odd column of each of the upper and the lower 2×2 matrices is the same as that in the even column thereof. Furthermore, the arrangement in the upper 2×2 matrix is the same as that in the lower 2×2 matrix.

When the lowest bit among the lower bits of the 9-bit data is zero, the number of the pixels having the value 'A+1' in each of the first four frames is the same as that in each of the second four frames. Furthermore, the arrangements of the first to the fourth frames of the first four frames are the same as those of the first to the fourth frames of the second four frames, respectively.

On the contrary, when the lowest bit is one, the number of the pixels having the value 'A+1' in each of the second four frames is larger than that in each of the second four frames by two. In detail, the first four frames for the lower bits having the lowest bit of '1' are the same as those for lower bits having a value less than them by one, while the second four frames therefor are the same as those for lower bits having a value larger than them by one.

Referring to FIG. 5, the lower bits (101) yield first four frames, which are the same as those of the lower bits (100), and yield second four frames, which are the same as those of the lower bits (110).

After summing the grays of all the eight pixels in all the eight frames, the division by the total number of the pixels in the eight frames, i.e., 8×8=64 yields the average gray, which ranges between 'A' and 'A+1'. More specifically, (000), (001), (010), (011), (100), (101), (110) and (111) represent 'A+0/8,' 'A+1/8,' 'A+2/8,' 'A+4/8,' 'A+5/8,' 'A+6/8,' and 'A+7/8,' respectively.

Examples of the mappings for N=8 and E=9, which are one-to-one mappings, will be now described with reference to FIGS. 7A to 9C.

A gray G of an 8-bit input data is mapped into a gray G' of a 9-bit data such that '0' is mapped into '0' while '255' is mapped into 504 (=63×23), where 63 (=111111) is the largest six-bit binary number. The mapping is substantially piecewise linear.

Figure 6:
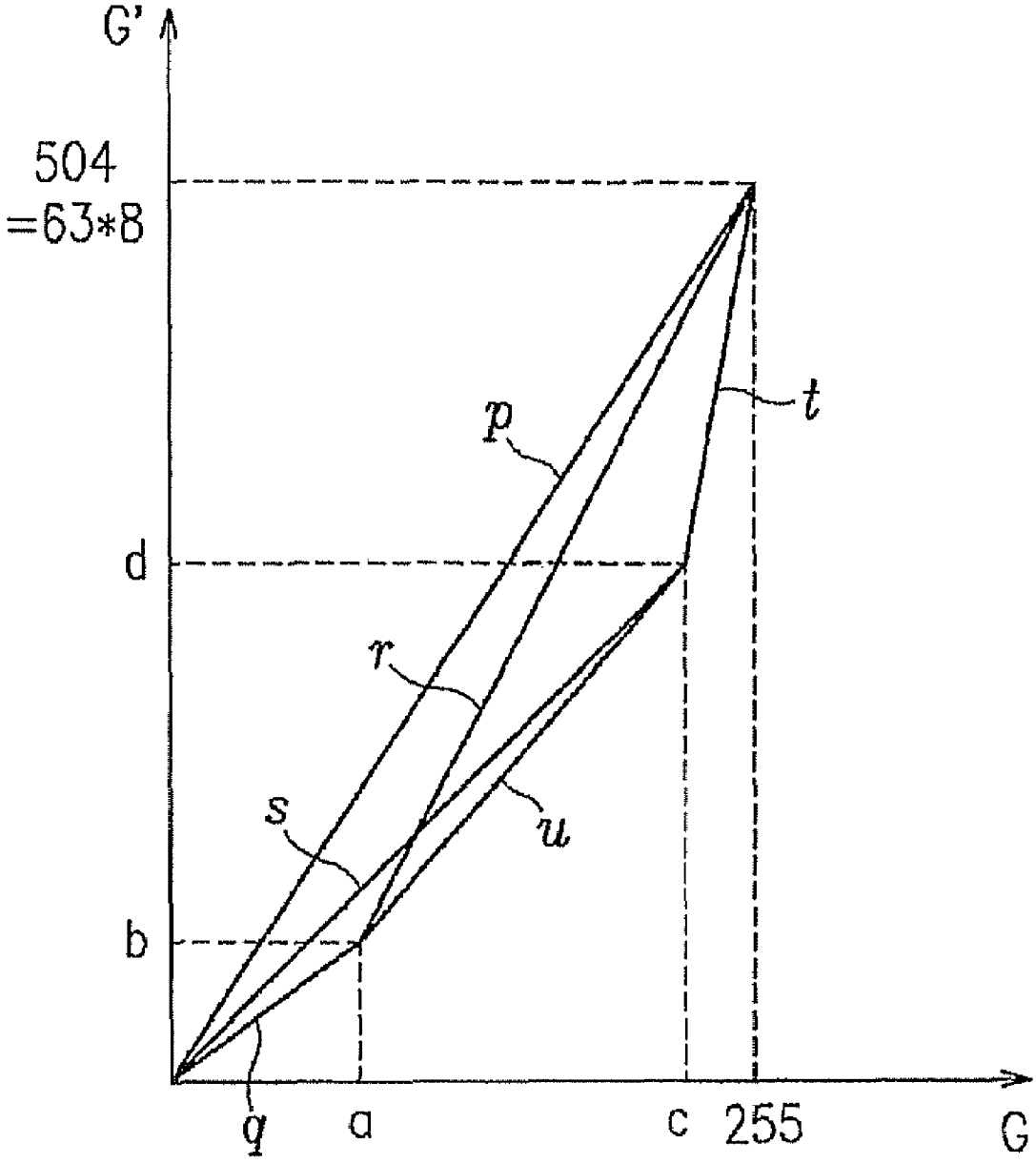
FIG. 6 is a graph illustrating exemplary mappings of G onto G' according to an embodiment of the present invention.

FIG. 6 is a graph illustrating exemplary mappings of G onto G' according to this embodiment of the present invention, which shows four different types of mappings.

The first type of the mapping, which is the simplest one of the mappings, is a line segment p connected between the points (0, 0) and (255, 504). The second and the third types of the mappings include two line segments q and r or s and t connected to each other. The two line segments q and r or s and t meet at (a, b) near (0, 0) or at (c, d) near (255, 504). The final one of the mappings includes three line segments q, u and t, which meet at (a, b) and (c, d). Since the gray G' is a natural number, the gray G' is obtained by rounding off the value of the line segments.

The following examples of mappings are obtained by assuming c=254 and a=b.

A first exemplary mapping is the first type mapping, i.e., the line segment connected between the points (0, 0) and (255, 504), which is given by:

$$G' = \left(\frac{63}{255}G \times 8\right)_{rounding} \tag{1}$$

where $(\ )_{rounding}$ means that the number in the parenthesis is rounded off to an integer. For simple realization of logic, the division by 255 is replaced with the multiplication of its reciprocal number, or is performed by using a look-up table.

The FRCed gray with the first exemplary mapping is equal to the input grays 0-21, and is lower than the input grays 22-63 by 0.5, the input grays 64-106 by 1.0, the input grays 107-148 by 1.5, the input grays 149-191 by 2.0, the input grays 192-233 by 2.5, and the input grays 234-255 by 3.0.

A second exemplary mapping is a third type mapping, which is given by:

$$G' = 504 \text{ if } G = 255; \text{ and} \tag{2}$$
$$G' = \left(\frac{63}{256}G \times 8\right)_{rounding} = \left(\frac{63}{32}G\right)_{rounding} \text{ if } G \text{ is not } 255.$$

Since the divisor is powers of two or multiples of eight, it can be easily realized in logic. The mapping of the grays other than 255 is easily obtained by multiplying G by 63 and then shifting the result into the direction of the lower bits by five bits.

The FRCed gray with the second exemplary mapping is equal to the input grays 0-16, and is lower than the input grays 17-48 by 0.5, the input grays 49-80 by 1.0, the input grays 81-112 by 1.5, the input grays 113-144 by 2.0, the input grays 145-176 by 2.5, the input grays 177-208 and 255 by 3.0, the input grays 209-240 by 3.5, and the input grays 241-254 by 4.0.

Figure 7A:
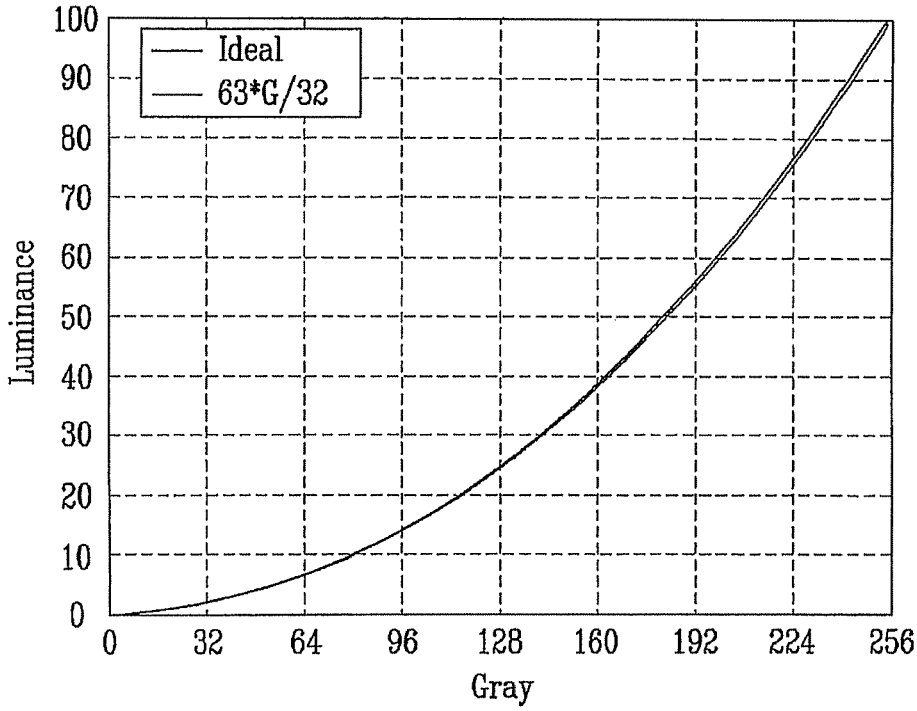
FIGS. 7A to 7C are graphs illustrating luminance as function of input gray for an ideal case and for the FRC with the second exemplary mapping.
Figure 7B:
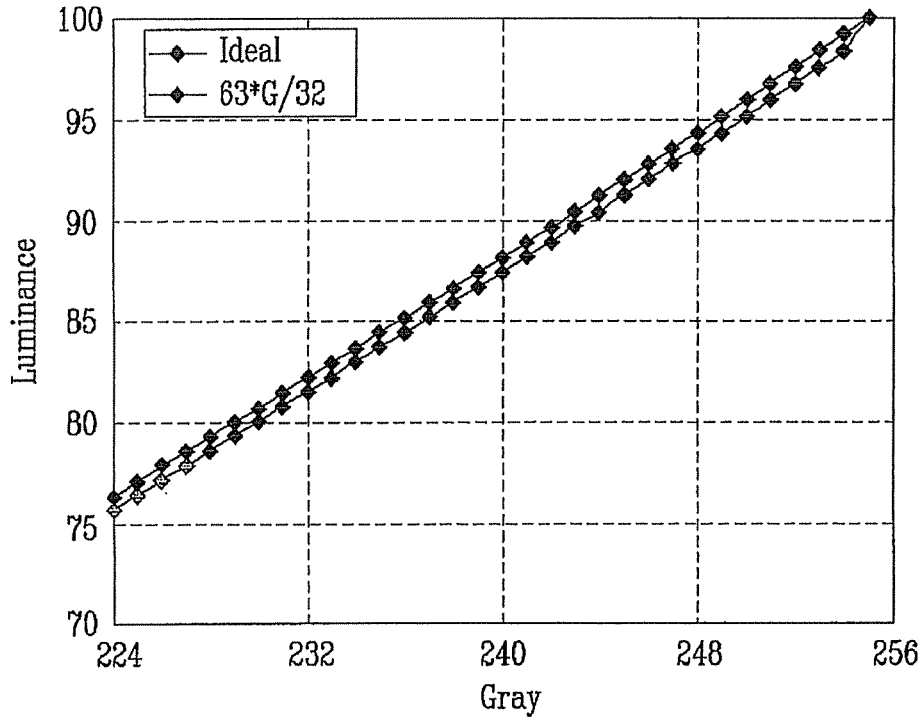
Figure 7C:
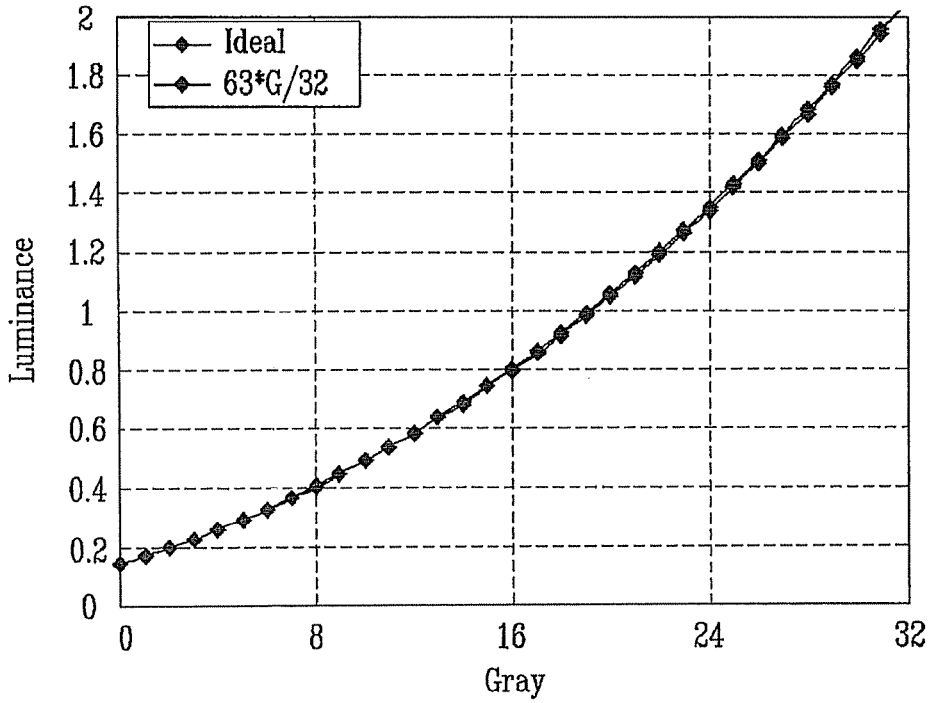

FIGS. 7A to 7C are graphs illustrating luminance as function of input gray for an ideal case and for the FRC with the second exemplary mapping. FIG. 7A shows all the grays, while FIGS. 7B and 7C show the upper grays and the lower grays, respectively.

As shown in FIGS. 7A to 7C, the luminance of the second exemplary mapping is almost the same as that of the ideal case at most of the grays except for some higher grays, where the luminance is slightly different for the two cases.

A third exemplary mapping is a second type mapping with a=b=6, which is given by:

$$G' = G \text{ if } G \le 6; \text{ and} \tag{3}$$
$$G' = \left(\left[\frac{64}{256}(G+1) - 1\right] \times 8\right) = 2G - 6 \text{ if } 6 < G \le 255.$$

The third mapping is relatively simple since it includes no division.

The FRCed gray with the third exemplary mapping is half of the input grays 0-6, that is, the FRCed gray is smaller than the input gray 1 by 0.5, the input gray 2 by 1.0, the input gray 3 by 1.5, the input gray 4 by 2.0, the input gray 5 by 2.5, and the input gray 6 by 3.0. The FRCed gray is smaller than the remaining input grays 7-255 by 3.0.

Figure 8A:
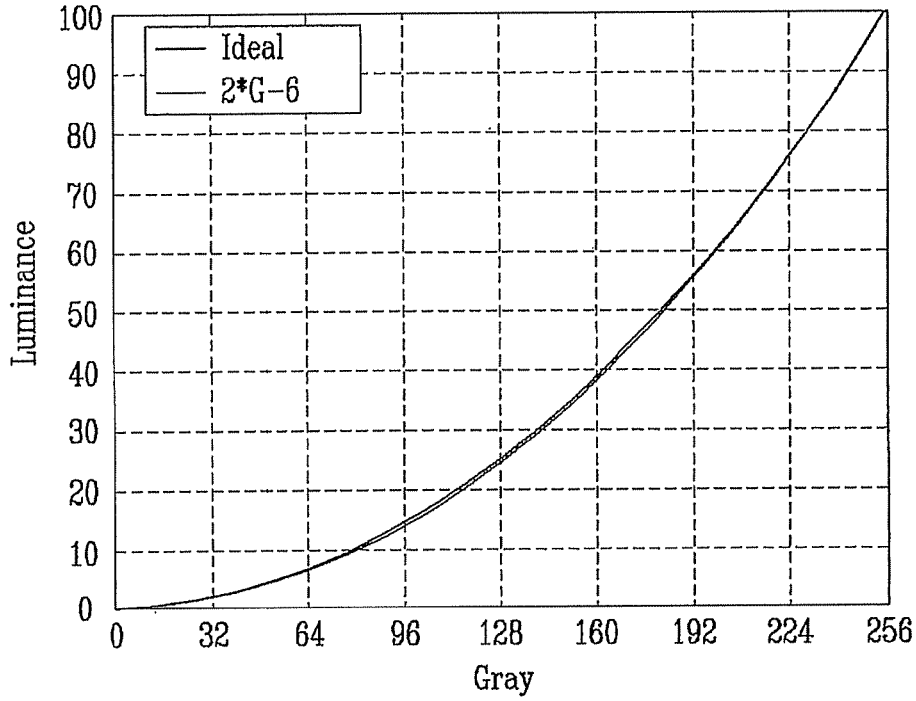
FIGS. 8A to 8C are graphs illustrating luminance as function of input gray for an ideal case and for the FRC with the third exemplary mapping.
Figure 8B:
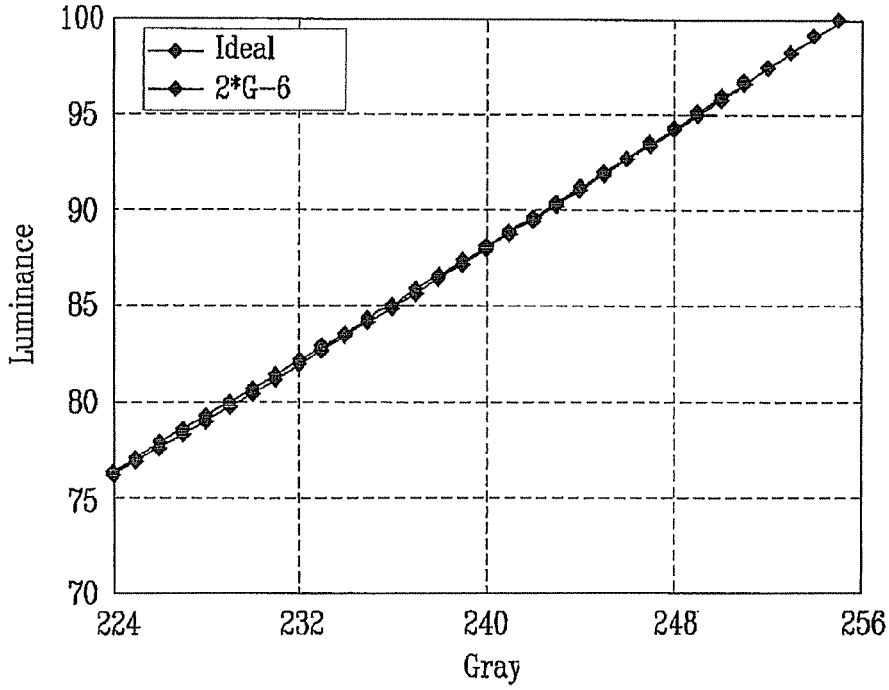
Figure 8C:
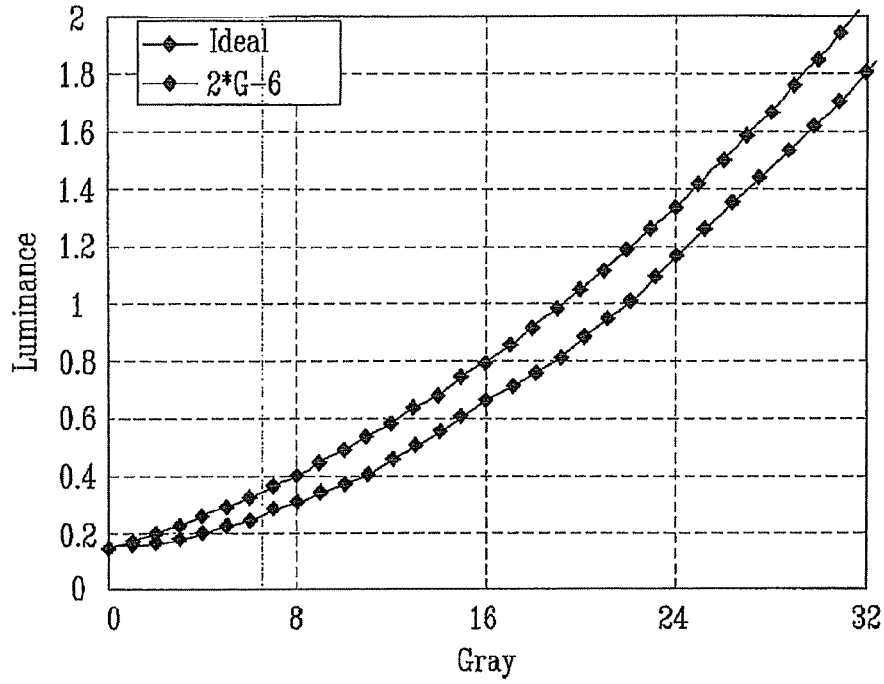

FIGS. 8A to 8C are graphs illustrating luminance as function of input gray for an ideal case and for the FRC with the third exemplary mapping. FIG. 8A shows all the grays, while FIGS. 8B and 8C show the upper grays and the lower grays, respectively.

Referring to FIG. 8C, although it appears that the difference between the FRC with the third exemplary mapping and the ideal case is large at the lower grays, it is only due to the scaling difference of the graph, and any considerable practical difference is not made.

A fourth exemplary mapping is a modified second type mapping, which is given by:

$$G' = 504 \text{ if } G = 255; \text{ and} \tag{4}$$
$$G' = \left(\left[\frac{63}{256}(G+1) - \frac{1}{8}\right] \times 8\right)_{rounding} = \left[\frac{63}{32}(G+1) - 1\right]_{rounding} \text{ if } G \text{ is not } 255.$$

It can be seen from Equation 4, the curve G' for G≠255 is equal to the second exemplary mapping for G≠255 shifted by (−1, −1).

The FRCed gray with the fourth exemplary mapping is larger than the input grays 0-15 by 0.5, is equal to the input grays 16-47, and is smaller than the input grays 48-79 by 0.5, the input grays 80-111 by 1.0, the input grays 112-143 by 1.5, the input grays 144-175 by 2.0, the input grays 176-207 by 2.5, the input grays 208-239 and 255 by 3.0, and the input grays 240-254 by 3.5.

Figure 9A:
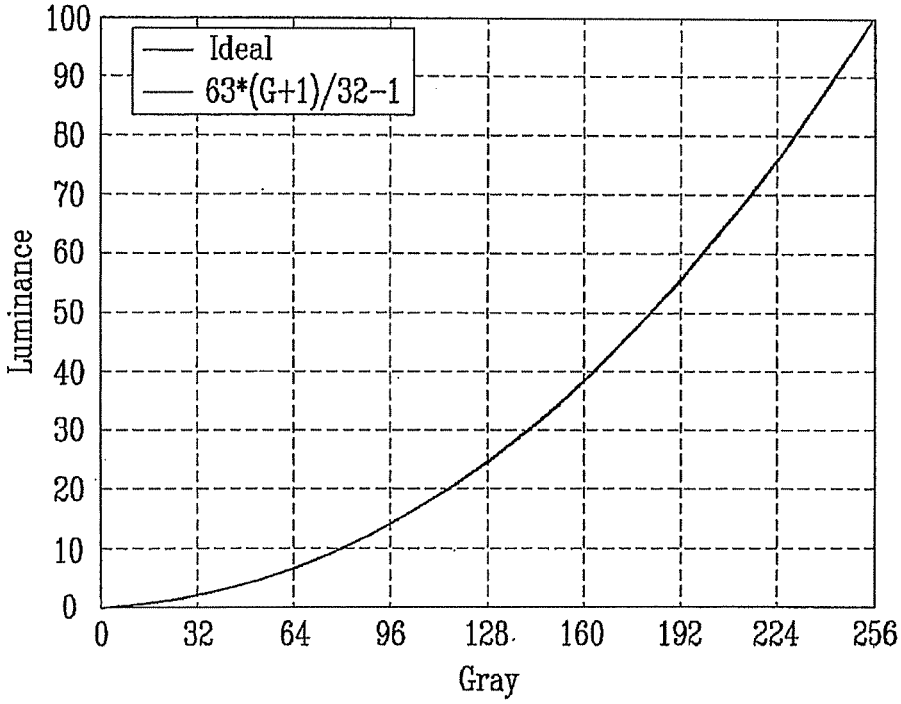
FIGS. 9A to 9C are graphs illustrating luminance as function of input gray for an ideal case and for the FRC with the fourth exemplary mapping.
Figure 9B:
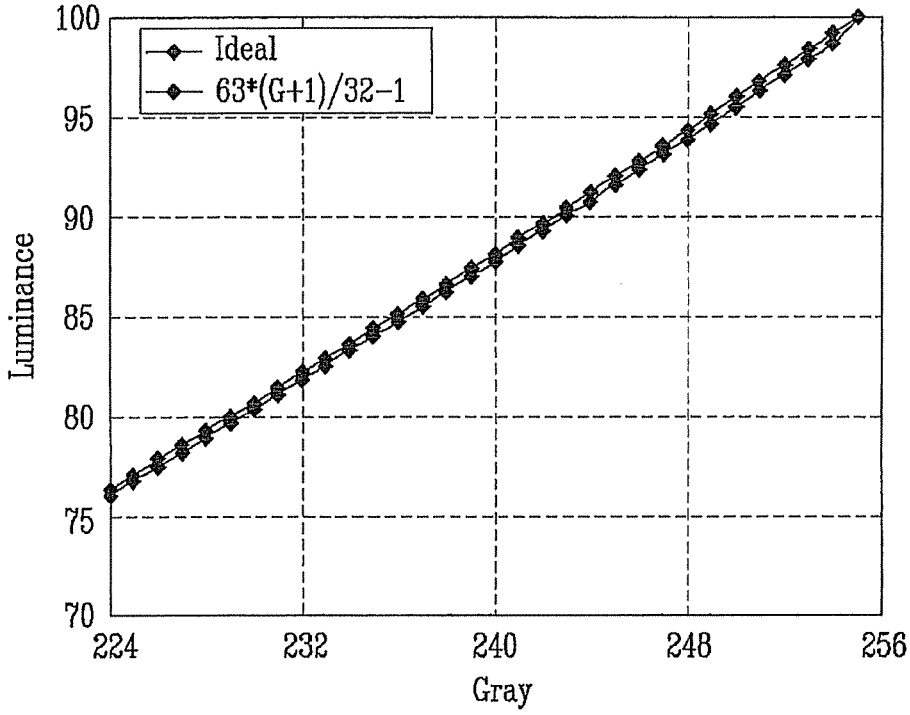
Figure 9C:
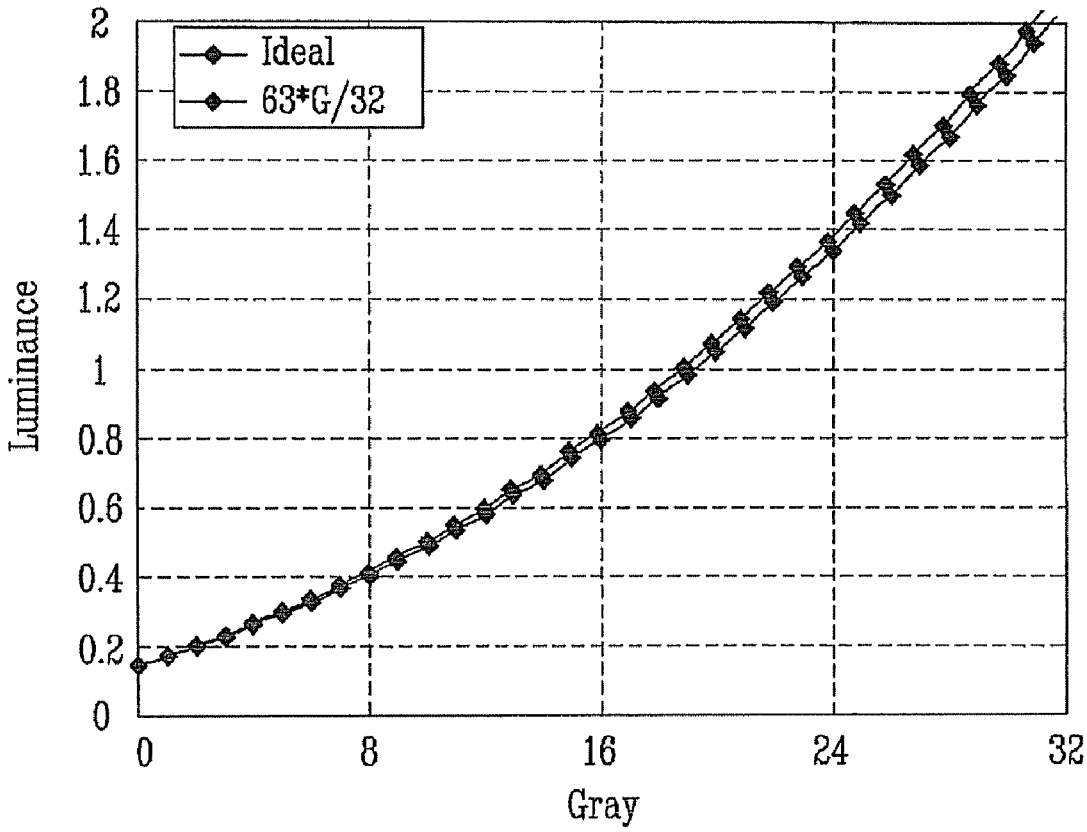

FIGS. 9A to 9C are graphs illustrating luminance as function of input gray for an ideal case and for the FRC with the fourth exemplary mapping. FIG. 9A shows all the grays, while FIGS. 9B and 9C show the upper grays and the lower grays, respectively.

As shown in FIGS. 9A to 9C, the difference between the ideal case and this example is very small compared with the second and the third example, this example is simple to realize compared with the first example.

A fifth exemplary mapping is a fourth type mapping, which is given by:

$$G' = G \text{ if } G \le 8;$$

$$G' = 504 \text{ if } G = 255; \text{ and}$$

$$G' = 2G - 8 \text{ if } 8 < G < 255. \tag{5}$$

The FRCed gray with the third exemplary mapping is half of the input grays 0-8, that is, the FRCed gray is smaller than the input gray 1 by 0.5, the input gray 2 by 1.0, the input gray 3 by 1.5, the input gray 4 by 2.0, the input gray 5 by 2.5, the input gray 6 by 3.0, the input gray 7 by 3.5, and the input gray 8 by 4.0. The FRCed gray is smaller than the remaining input grays 9-255 by 4.0.

According to another embodiment of the present invention, FRC is performed such that pairs of conjugate frames, which are defined as a pair of frames having pixel arrangements which are symmetrical to a boundary line between an upper 2×2 matrix and a lower 2×2 matrix of a 4×2 pixel block, are periodically repeated in time and space.

Applicant found that the deterioration in the picture image quality that a horizontal line appears every four gray levels in a screen having a gray decreasing along a column direction can be reduced by this embodiment.

Figure 10:
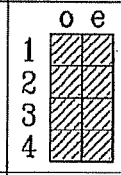
FIGS. 10-12 are tables for illustrating exemplary FRC on 8-bit RGB input data according to another embodiment of the present invention.
Figure 10:
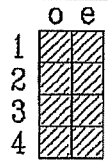
Figure 10:
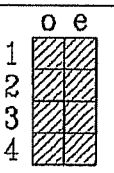
Figure 10:
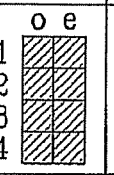
Figure 10:
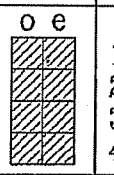
Figure 10:
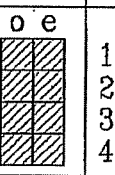
Figure 10:
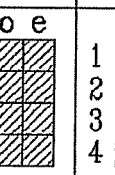
Figure 10:
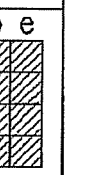
Figure 10:
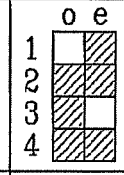
Figure 10:
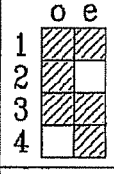
Figure 10:
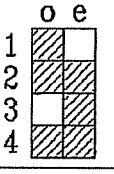
Figure 10:
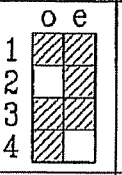
Figure 10:
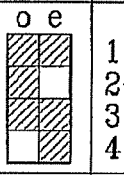
Figure 10:
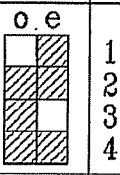
Figure 10:
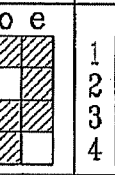
Figure 10:
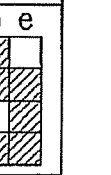
Figure 10:
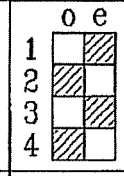
Figure 10:
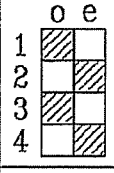
Figure 10:
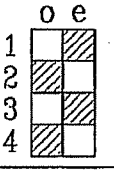
Figure 10:
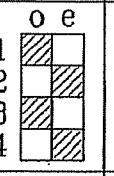
Figure 10:
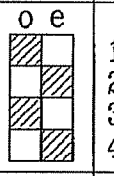
Figure 10:
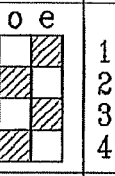
Figure 10:
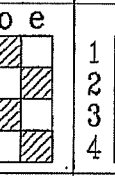
Figure 10:
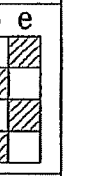
Figure 10:
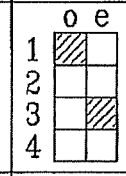
Figure 10:
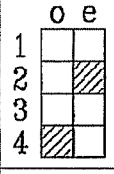
Figure 10:
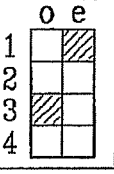
Figure 10:
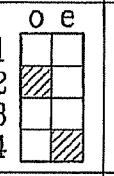
Figure 10:
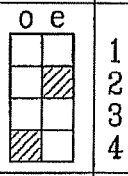
Figure 10:
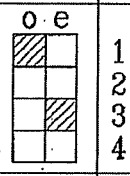
Figure 10:
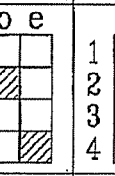
Figure 10:
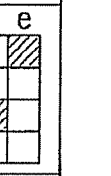
Figure 10:
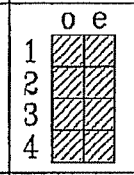
Figure 10:
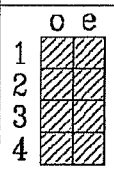
Figure 10:
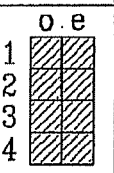
Figure 10:
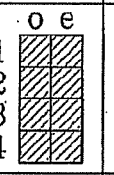
Figure 10:
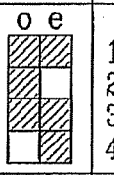
Figure 10:
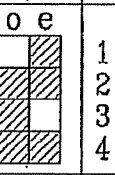
Figure 10:
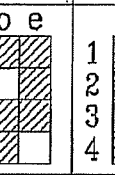
Figure 10:
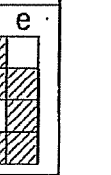
Figure 10:
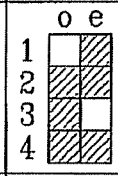
Figure 10:
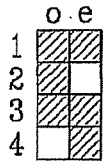
Figure 10:
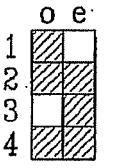
Figure 10:
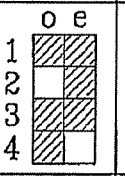
Figure 10:
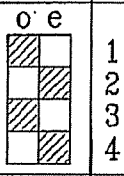
Figure 10:
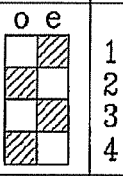
Figure 10:
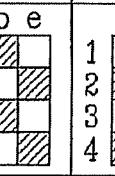
Figure 10:
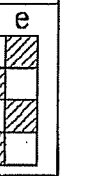
Figure 10:
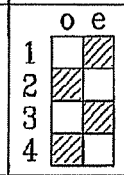
Figure 10:
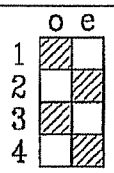
Figure 10:
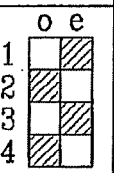
Figure 10:
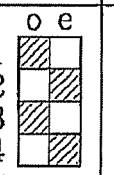
Figure 10:
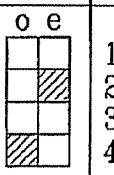
Figure 10:
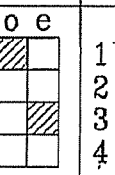
Figure 10:
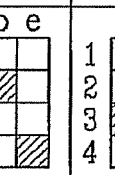
Figure 10:
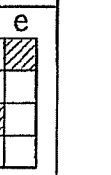
Figure 10:
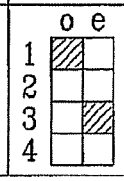
Figure 10:
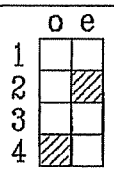
Figure 10:
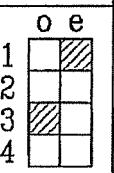
Figure 10:
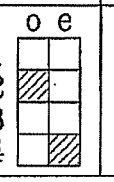
Figure 10:
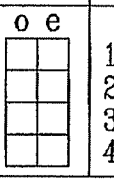
Figure 10:
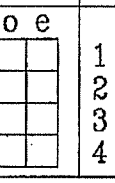
Figure 10:
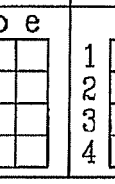
Figure 10:
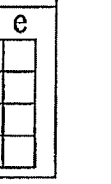
Figure 11:
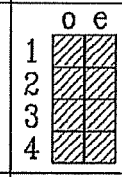
Figure 11:
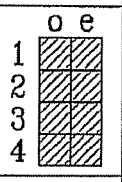
Figure 11:
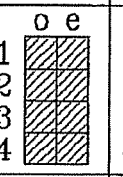
Figure 11:
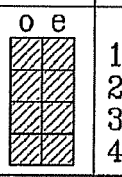
Figure 11:
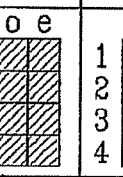
Figure 11:
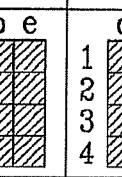
Figure 11:
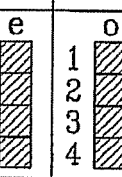
Figure 11:
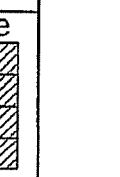
Figure 11:
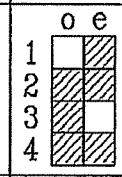
Figure 11:
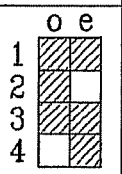
Figure 11:
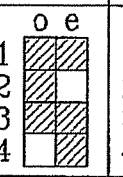
Figure 11:
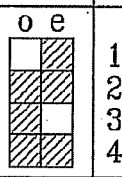
Figure 11:
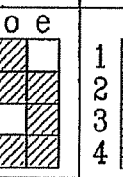
Figure 11:
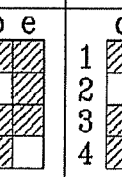
Figure 11:
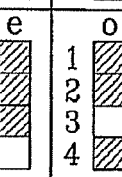
Figure 11:
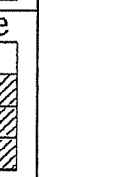
Figure 11:
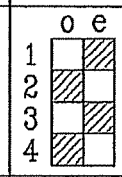
Figure 11:
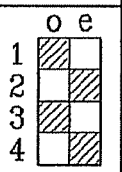
Figure 11:
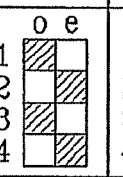
Figure 11:
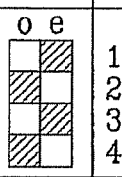
Figure 11:
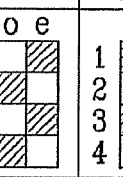
Figure 11:
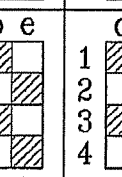
Figure 11:
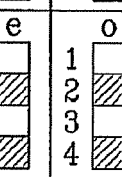
Figure 11:
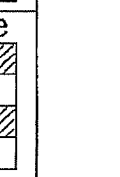
Figure 11:
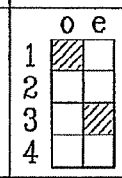
Figure 11:
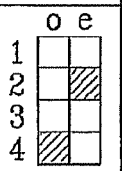
Figure 11:
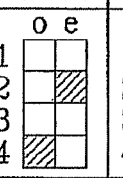
Figure 11:
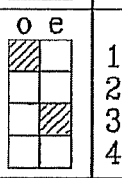
Figure 11:
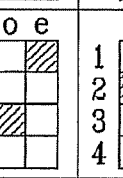
Figure 11:
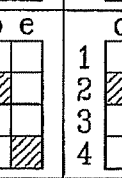
Figure 11:
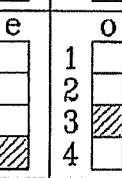
Figure 11:
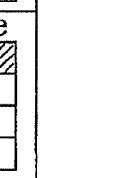
Figure 11:
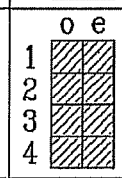
Figure 11:
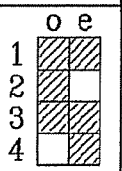
Figure 11:
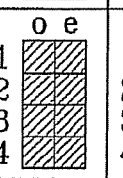
Figure 11:
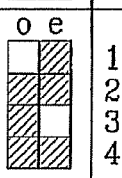
Figure 11:
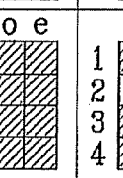
Figure 11:
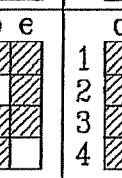
Figure 11:
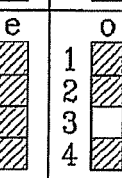
Figure 11:
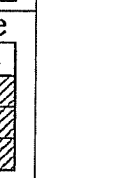
Figure 11:
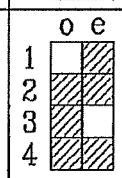
Figure 11:
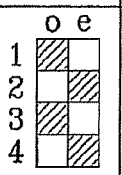
Figure 11:
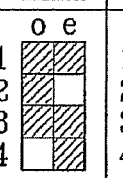
Figure 11:
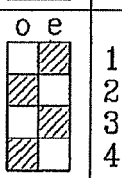
Figure 11:
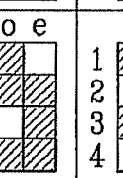
Figure 11:
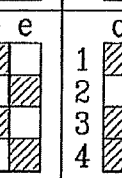
Figure 11:
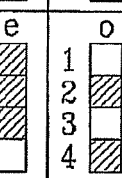
Figure 11:
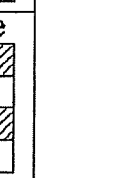
Figure 11:
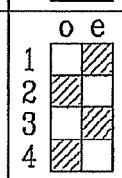
Figure 11:
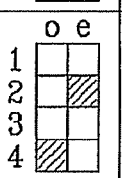
Figure 11:
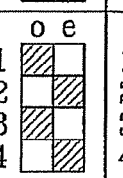
Figure 11:
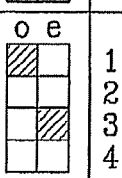
Figure 11:
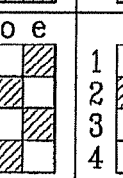
Figure 11:
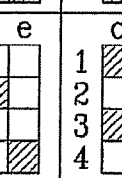
Figure 11:
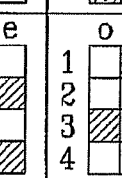
Figure 11:
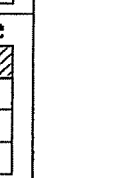
Figure 11:
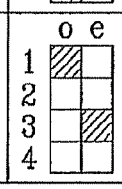
Figure 11:
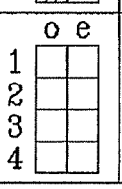
Figure 11:
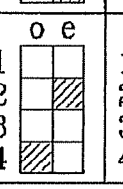
Figure 11:
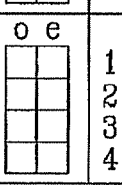
Figure 11:
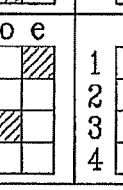
Figure 11:
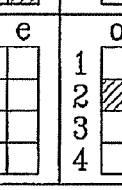
Figure 11:
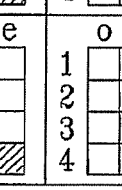
Figure 11:
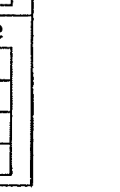
Figure 12:
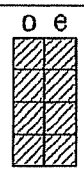
Figure 12:
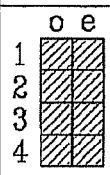
Figure 12:
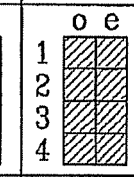
Figure 12:
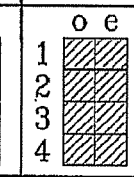
Figure 12:
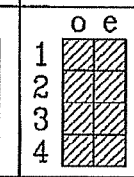
Figure 12:
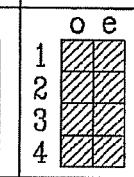
Figure 12:
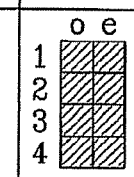
Figure 12:
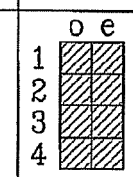
Figure 12:
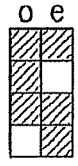
Figure 12:
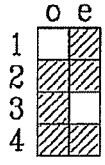
Figure 12:
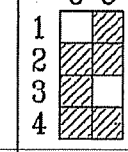
Figure 12:
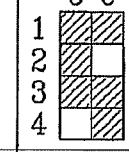
Figure 12:
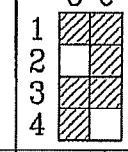
Figure 12:
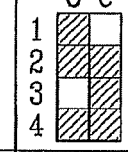
Figure 12:
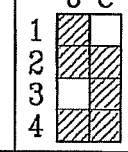
Figure 12:
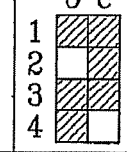
Figure 12:
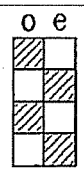
Figure 12:
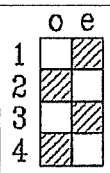
Figure 12:
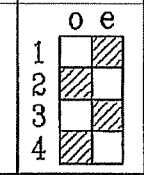
Figure 12:
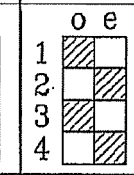
Figure 12:
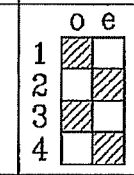
Figure 12:
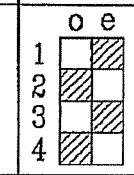
Figure 12:
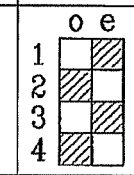
Figure 12:
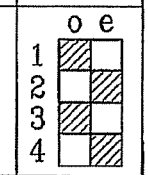
Figure 12:
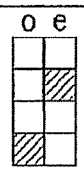
Figure 12:
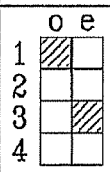
Figure 12:
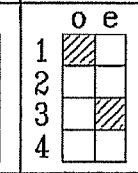
Figure 12:
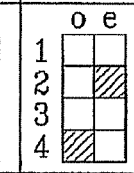
Figure 12:
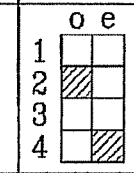
Figure 12:
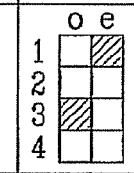
Figure 12:
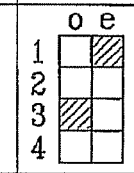
Figure 12:
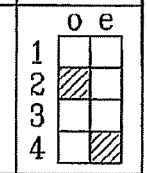
Figure 12:
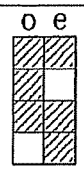
Figure 12:
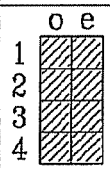
Figure 12:
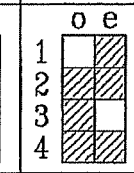
Figure 12:
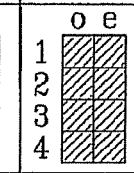
Figure 12:
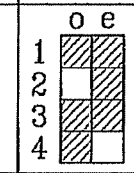
Figure 12:
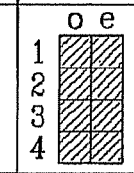
Figure 12:
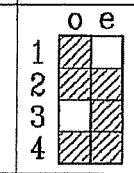
Figure 12:
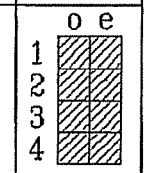
Figure 12:
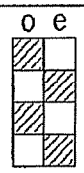
Figure 12:
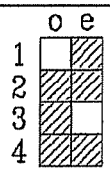
Figure 12:
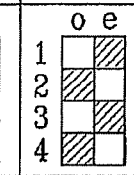
Figure 12:
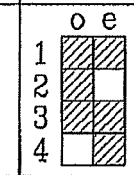
Figure 12:
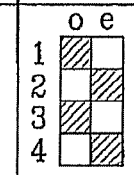
Figure 12:
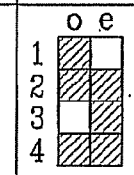
Figure 12:
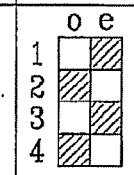
Figure 12:
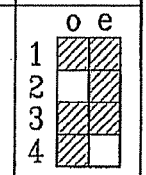
Figure 12:
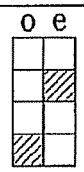
Figure 12:
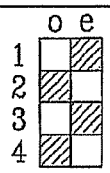
Figure 12:
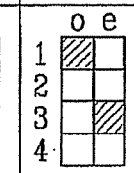
Figure 12:
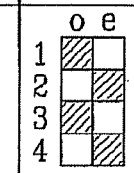
Figure 12:
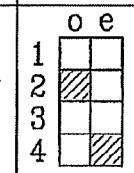
Figure 12:
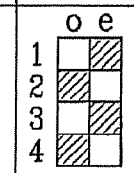
Figure 12:
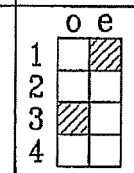
Figure 12:
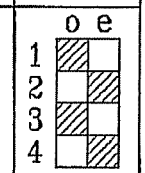
Figure 12:
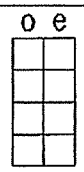
Figure 12:
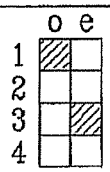
Figure 12:
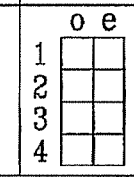
Figure 12:
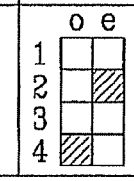
Figure 12:
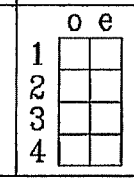
Figure 12:
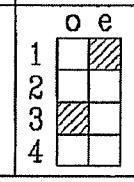
Figure 12:
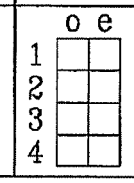
Figure 12:
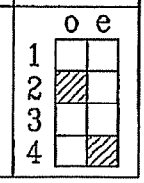

FIGS. 10-12 are tables for illustrating exemplary FRC on 8-bit RGB input data with N=8, E=9 and β=3 according to this embodiment of the present invention, which periodically repeats pairs of conjugate frames in time.

FIG. 10 shows first four frames (1, 2, 3 and 4) equal to the first frames shown in FIG. 5 and second four frames ($\bar{5}$,$\bar{6}$,$\bar{7}$,$\bar{8}$) conjugate to the second four frames shown in FIG. 5. As shown in FIG. 10, the second four frames for (000), (010), (100) and (110) are also conjugate to the first four frames therefor, while the second four frames for (001), (011) and (101) are conjugate to the first frames for (010), (100) and (110) and the second four frames for (111) are conjugate to themselves. Hereinafter, the frames ($\bar{5}$,$\bar{6}$,$\bar{7}$,$\bar{8}$) are referred to as conjugate frames, while the (1, 2, 3, 4) are normal frames.

FIG. 11 shows the frames arranged in sequence of 1, $\bar{5}$, 2, $\bar{6}$, 3, $\bar{7}$, 4 and $\bar{8}$, i.e., the normal frames and the conjugate frames are alternately arranged, while FIG. 12 shows the frames arranged in sequence of $\bar{5}$, 1, $\bar{6}$, 2, $\bar{7}$, 3, $\bar{8}$ and 4 contrary to FIG. 11. It was found that this arrangement is very effective in preventing deterioration in the picture image quality compared with FIG. 10.

Figure 13A:
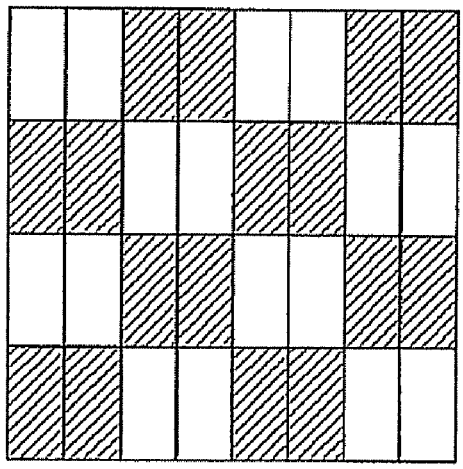
FIGS. 13A and 13B illustrate an exemplary FRC according to another embodiment of the present invention.
Figure 13B:
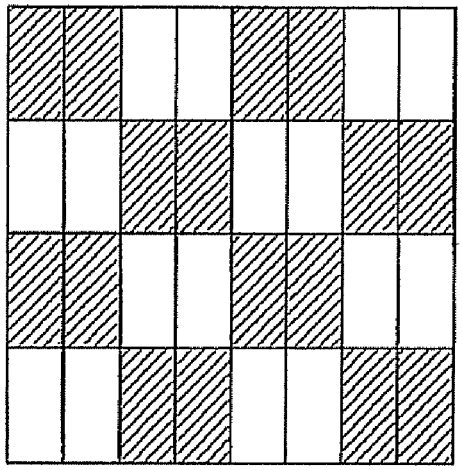

FIGS. 13A and 13B illustrate an exemplary FRC according to this embodiment of the present invention, which periodically repeats normal frames and conjugate frames in space as well as time.

FIGS. 13A and 13B show a screen of a frame and the next frame, respectively. In FIGS. 13A and 13B, one block is a 4×2 pixel block and white blocks are subject to normal frames and hatched blocks are subject to conjugate frames. As shown in FIGS. 13A and 13B, the normal frames and the conjugate frames are repeated by a 4×4 pixel block, which includes two 4×2 pixel blocks adjacent in a row direction. In addition, the pixel arrangements in FIGS. 13A and 13B are reversed.

This example effectively removes flicker and deterioration in the picture image quality.

Figure 14:
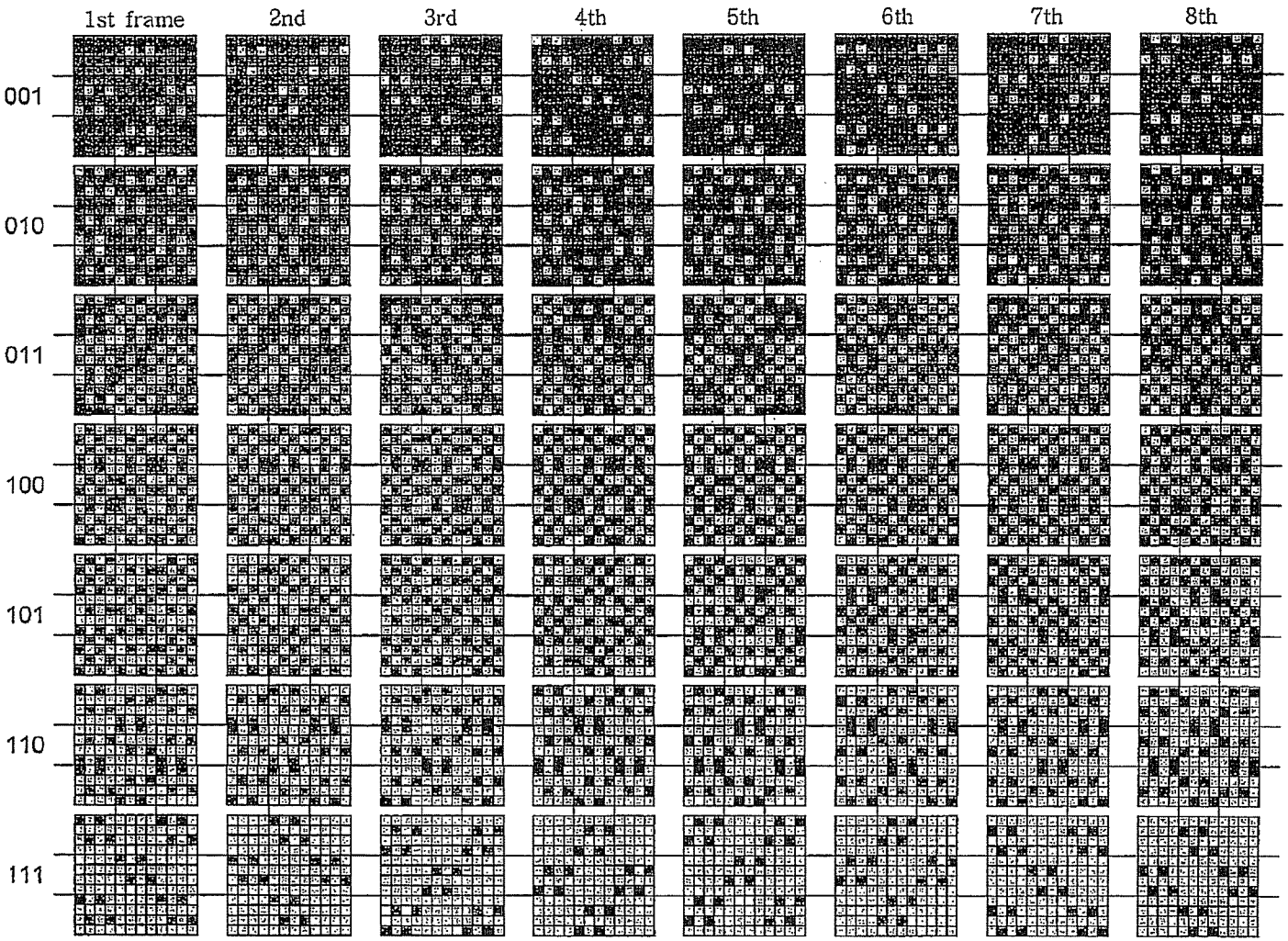
FIGS. 14 and 15 show a screen of an LCD subject to the FRC shown in FIGS. 13A and 13B on 8-bit RGB input data for the value of the lower three bits and the consecutive eight frames.
Figure 15:
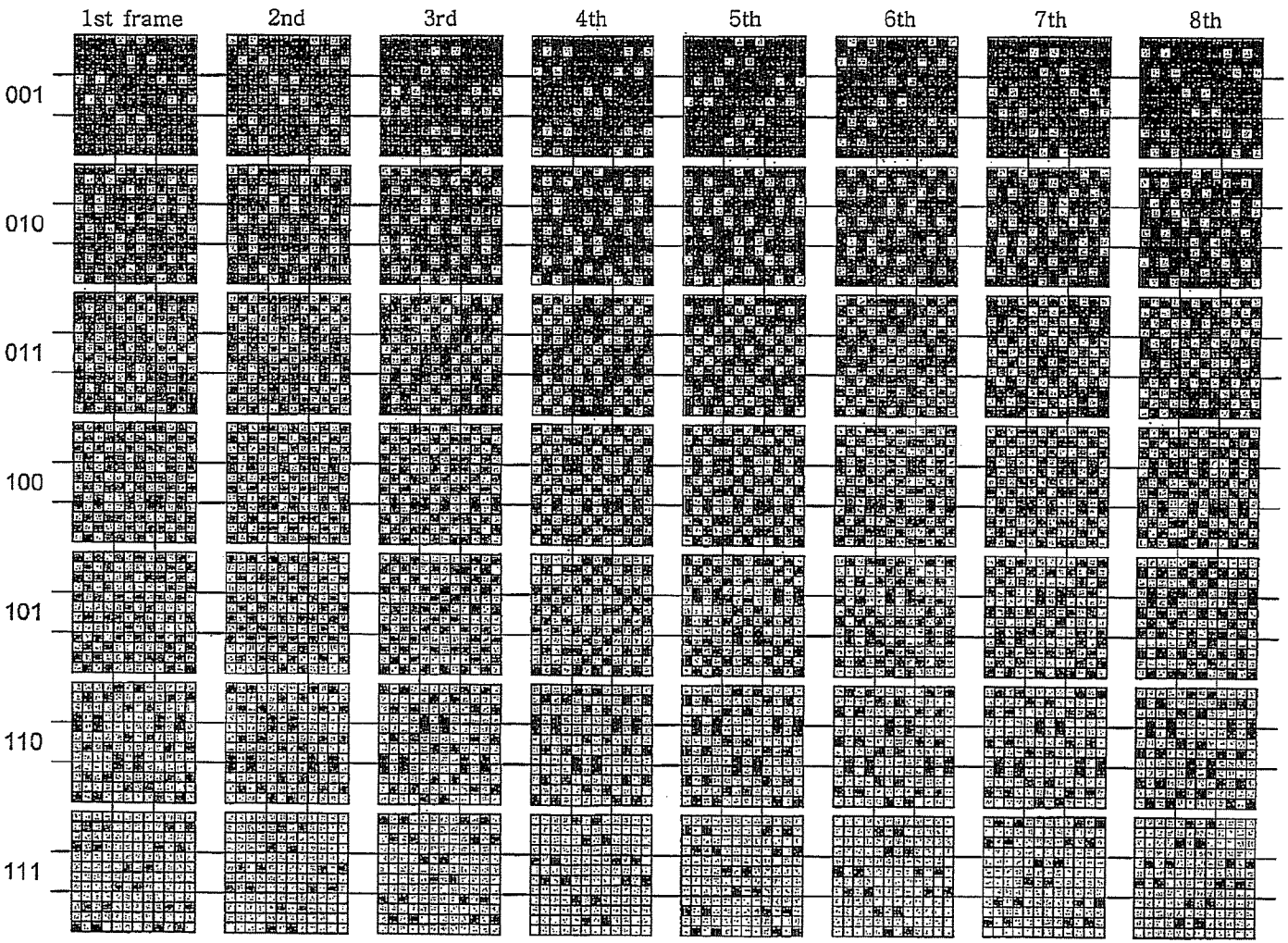

FIGS. 14 and 15 show a screen of an LCD subject to the FRC shown in FIGS. 13A and 13B on 8-bit RGB input data with N=8, E=9 and β=3, for the value of the lower three bits and the consecutive eight frames.

FIG. 14 illustrates pixel arrangements for red and green colors while FIG. 15 illustrates pixel arrangements for blue color. As shown in FIGS. 14 and 15, the spatial repetition unit is a 4×4 pixel block. Each 4×4 pixel block is repeatedly subject to the normal frames and the conjugate frames.

For example, the case that the value of the lower three bits is (011) is described in detail with reference to FIGS. 14 and 15 and FIG. 10. FIGS. 14 and 15 show nine 4×4 pixel blocks arranged in a matrix and thus each 4×4 pixel block is identified by its row and column. For example, the left uppermost 4×4 pixel block is referred to as the block (1, 1), the middle uppermost 4×4 pixel block is referred to as the block (1, 2), and so on. Furthermore, the numerals 1, $\bar{5}$, 2, $\bar{6}$, 3, $\bar{7}$, 4 and $\bar{8}$indicating the frames in FIG. 10 are also used for indicating the pixel arrangements of the frames.

Referring to FIG. 14, the blocks (1, 1), (1, 3), (2, 2), (3, 1) and (3, 3) have the arrangement 1, while the blocks (1, 2), (2, 1), (2, 3) and (3, 2) have the arrangement $\bar{5}$, in the first frame. In the second frame, the blocks (1, 1), (1, 3), (2, 2), (3, 1) and (3, 3) have the arrangement $\bar{5}$, while the blocks (1, 2), (2, 1), (2, 3) and (3, 2) have the arrangement 1. In the third and the fourth frames, the blocks (1, 1), (1, 3), (2, 2), (3, 1) and (3, 3) have the arrangements 2 and $\bar{6}$, respectively, while the blocks (1, 2), (2, 1), (2, 3) and (3, 2) have the arrangements 6 and 2, respectively. In the fifth to the eighth frames, the blocks (1, 1), (1, 3), (2, 2), (3, 1) and (3, 3) have the arrangements 3, $\bar{7}$, 4 and $\bar{8}$, respectively, while the blocks (1, 2), (2, 1), (2, 3) and (3, 2) have the arrangements $\bar{7}$, 3, $\bar{8}$, 4, respectively.

Referring to FIG. 15, the blocks (1, 1), (1, 3), (2, 2), (3, 1) and (3, 3) have the arrangement 2, while the blocks (1, 2), (2, 1), (2, 3) and (3, 2) have the arrangement $\bar{6}$, in the first frame. In the second frame, the blocks (1, 1), (1, 3), (2, 2), (3, 1) and (3, 3) have the arrangement $\bar{6}$, while the blocks (1, 2), (2, 1), (2, 3) and (3, 2) have the arrangement 2. In the third and the fourth frames, the blocks (1, 1), (1, 3), (2, 2), (3, 1) and (3, 3) have the arrangements 1 and $\bar{5}$, respectively, while the blocks (1, 2), (2, 1), (2, 3) and (3, 2) have the arrangements $\bar{5}$ and 3, respectively. In the fifth to the eighth frames, the blocks (1, 1), (1, 3), (2, 2), (3, 1) and (3, 3) have the arrangements 4, $\bar{8}$, 3 and $\bar{7}$, respectively, while the blocks (1,2), (2,1), (2,3) and (3,2) have the arrangements $\bar{8}$, 4, $\bar{7}$ and 3, respectively.

In the meantime, the arrangements 1 and 2, 3 and 4, $\bar{5}$ and $\bar{6}$, and $\bar{7}$ and $\bar{8}$ have conjugate relations, respectively, as shown in FIGS. 14 and 15. Accordingly, the arrangements shown in FIGS. 14 and 15 have a conjugate relation.

As described above, when the gray levels are arranged in a vertical direction, the appearance of the horizontal line is closely related to the inversion driving. For the green color, the horizontal line becomes clear when the gray is darkened downwards, whereas for the red and blue colors it becomes clear when the gray is darkened upwards. This proves to be due to the polarity inversion. The FRC for the red and green colors is performed as shown in FIG. 14, while the FRC for the blue color is performed in conjugate manner with respect to that shown in FIG. 14, as shown in FIG. 15. Consequently, this FRC is less influenced by the inversion type so that the picture image quality can be improved.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A method of driving a liquid crystal display by frame rate control (FRC), the method comprising:

receiving a plurality of raw data each having n bits;

converting each of the raw data into converted data having n-d bits, where d is a predetermined number of lowermost bits; and performing FRC on the converted data during $2^d$ frames, wherein the raw data corresponding to 1st to $2^d$-th lowest brightness levels of the plurality of raw data, display a same luminance.

2. The method of claim 1, wherein n is 8 and d is 2.

3. The method of claim 1, wherein the raw data corresponding to the 1st to $2^d$-th lowest brightness levels of the plurality of raw data, display minimum luminance.

4. A method of driving a liquid crystal display by frame rate control (FRC), the method comprising:

receiving raw data having n bits;

extending the raw data into extended data having e bits, where e is bigger than n;

converting the extended data into converted data having e-d bits, where d is a predetermined number of lowermost bits;

performing FRC on the converted data during $2^d$ frames.

5. The method of claim 4, wherein n is 8, e is 9 and d is 3.

6. The method of claim 4, wherein FRC is performed by pixel blocks.

7. The method of claim 6, wherein FRC is performed such that the pixel block is alternately subject to a normal frame and a conjugate frame for two adjacent frames.

8. The method of claim 7, wherein the conjugate frame and the normal frame are top-bottom inverted with respect to a center line of the pixel block.

9. The method of claim 7, wherein the normal frame and the conjugate frame are repeated every $2^d$ frames.

10. The method of claim 7, wherein the normal frame and the conjugate frame are repeated every frame.

11. The method of claim 7, wherein the pixel block has 4×2 size.

12. The method of claim 7, wherein the FRC is performed in time and space.

13. The method of claim 7, wherein the FRC is performed by colors.

14. The method of claim 13, wherein the FRC for red and green colors is performed in one of the normal frame and the conjugate frame, and the FRC for blue color is performed in the other of the normal frame and the conjugate frame in a certain frame.

* * * * *